US009014603B2

(12) United States Patent
Shiobara

(10) Patent No.: US 9,014,603 B2
(45) Date of Patent: Apr. 21, 2015

(54) DRIVING DEVICE AND IMAGE FORMING APPARATUS

(75) Inventor: Toshimasa Shiobara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 216 days.

(21) Appl. No.: 13/233,047

(22) Filed: Sep. 15, 2011

(65) Prior Publication Data

US 2012/0070201 A1 Mar. 22, 2012

(30) Foreign Application Priority Data

Sep. 17, 2010 (JP) ..... 2010-208806

(51) Int. Cl.
*G03G 15/01* (2006.01)
*G03G 15/16* (2006.01)

(52) U.S. Cl.
CPC ..... *G03G 15/1615* (2013.01); *G03G 15/0131* (2013.01); *G03G 15/0189* (2013.01)

(58) Field of Classification Search
USPC ..... 399/299, 302; 474/147
See application file for complete search history.

(56) References Cited

U.S. PATENT DOCUMENTS

| | | | | |
|---|---|---|---|---|
| 4,397,538 | A | 8/1983 | Castelli et al. | |
| 6,055,397 | A | 4/2000 | Lee | |
| 2007/0110471 | A1 * | 5/2007 | Kitamura | 399/101 |

FOREIGN PATENT DOCUMENTS

| | | |
|---|---|---|
| JP | 8-54790 | 2/1996 |
| JP | 8-282009 | 10/1996 |
| JP | 9-297469 | 11/1997 |
| JP | 2004-123363 | 4/2004 |
| JP | 2006-162659 A | 6/2006 |
| JP | 2007-8677 | 1/2007 |
| JP | 2009-265421 | 11/2009 |

OTHER PUBLICATIONS

Mori (JP 2009-265421 A, Nov. 2009) JPO Computer Translation.*

* cited by examiner

*Primary Examiner* — Erika J Villaluna
(74) *Attorney, Agent, or Firm* — Rabin & Berdo, P.C.

(57) ABSTRACT

A driving device includes a stretched member, and a first rotation member and a second rotation member that support the stretched member in a stretched manner. The first rotation member has a first rotation axis, and the second rotation member has a second rotation axis. The first rotation member includes a plurality of members arranged in an axial direction of the first rotation axis.

21 Claims, 20 Drawing Sheets

43
42
O2
O1
Xt
m
X
Y1
Y2

DRIVING DEVICE AND IMAGE FORMING APPARATUS

BACKGROUND OF THE INVENTION

The present invention relates to a driving device in which a stretched member (for example, as an endless belt) is stretched around a plurality of rollers and moved the by the rollers, and an image forming apparatus using the driving device.

There has been proposed a technology for preventing the skew of the endless belt (Japanese Laid-open Patent Publication No. 2006-162659).

However, although the prior art is capable of preventing the skew of the endless belt, a lengthening of a lifetime of the endless belt (i.e., the stretched member) is not sufficiently achieved.

SUMMARY OF THE INVENTION

In an aspect of the present invention, it is intended to provide a driving device and an image forming apparatus capable of lengthen a lifetime of a stretched member.

According to an aspect of the present invention, there is provided a driving device including a stretched member, and a first rotation member and a second rotation member around which the stretched member is stretched. The first rotation member has a first rotation axis, and the second rotation member has a second rotation axis. The first rotation member includes a plurality of members arranged in an axial direction of the first rotation axis.

With such a configuration, a lifetime and reliability of the stretched member can be enhanced.

According to another aspect of the present invention, there is provided an image forming unit including the above described driving device.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

<Configuration>

Figure 1:
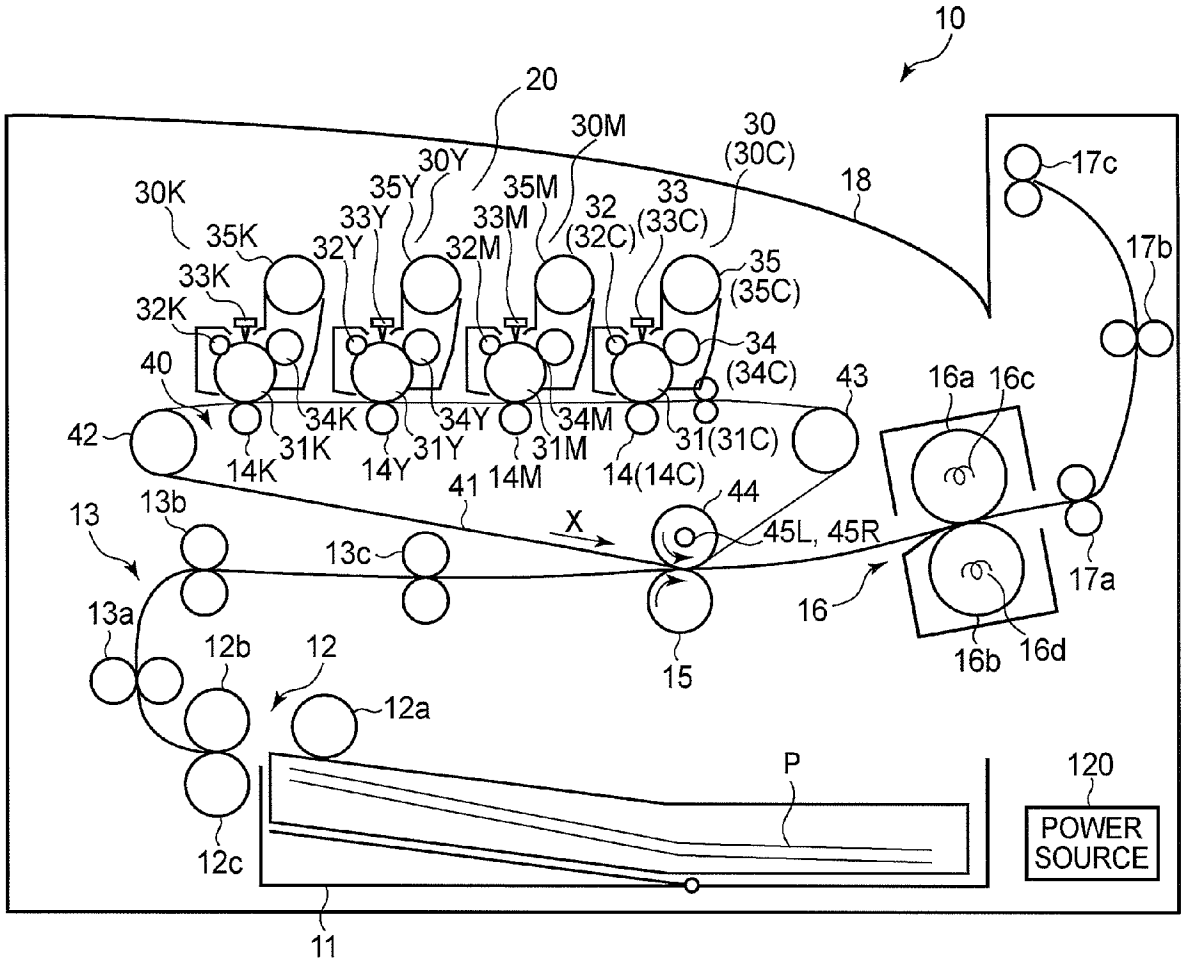
FIG. 1 is a schematic sectional view showing a configuration of an image forming apparatus according to the first embodiment of the present invention.

FIG. 1 is a schematic view showing a configuration of an image forming apparatus 10 according to the first embodiment of the present invention.

The image forming apparatus 10 is configured as, for example, an electrophotographic printer of an intermediate transfer type. The image forming apparatus 10 includes a medium tray 11 in which recording media (for example, sheets) P are stored. A medium feeding unit 12 is provided on a feeding side (i.e., left side in FIG. 1) of the medium tray 11. The medium feeding unit 12 is configured to feed the recording medium P one by one out of the medium tray 11. The medium feeding unit 12 includes a pickup roller 12*a* pressed against the topmost recording medium P lifted to a predetermined height. The medium feeding unit 12 further includes a feeding roller 12*b* and a retard roller 12*c* for separately feeding the recording medium P picked up by the pickup roller 12*a*. A medium conveying unit 13 is provided on a downstream side of the medium feeding unit 12 in a conveying direction of the recording medium P. The medium conveying unit 13 includes a plurality of conveying roller pairs 13*a*, 13*b* and 13*c* for conveying the recording medium P toward a transfer roller 15 described later.

An image forming portion 20 includes four toner image forming units 30 (30C, 30M, 30Y and 30K) as developer image forming units, four transfer rollers 14 (14C, 14M, 14Y and 14K), and a transfer roller 15. The toner image forming units 30 are arranged in tandem, and respectively form toner images (i.e., developer images). The transfer rollers 14 are configured to primarily transfer the toner images to an intermediate transfer belt 41 described later. The transfer roller 15 is configured to secondarily transfer the toner image from the intermediate transfer belt 41 to the recording medium P. Therefore, the transfer rollers 14 are also referred to as primary transfer rollers, and the transfer roller 15 are also referred to as a secondary transfer roller.

The toner image forming units 30 include OPC (Organic Photo Conductor) drums 31 (31C, 31M, 31Y, 31K) as image bearing bodies that bear toner images, charging rollers 32 (32C, 32M, 32Y, 32K) as charging members that negatively charge the surfaces of the OPC drums 31, printing heads 33 (33C, 33M, 33Y, 33K) as exposure units that expose the surfaces of the OPC drums 31 to form latent images, developing rollers 34 (34C, 34M, 34Y, 34K) as developing members that develop the latent images to form toner images, and developer supply units 35 (35C, 35M, 35Y and 35K) that supply toners to the developing rollers 34. The printing heads 33 are constituted by, for example, LED (Light Emitting Diode) arrays.

A transfer belt unit 40 as a driving device (i.e., a belt driving device) includes an intermediate transfer belt 41 (i.e., a stretched member). The intermediate transfer belt 41 also functions as a toner (developer) image bearing body. The intermediate transfer belt 41 is an endless belt, and is configured to carry the toner image having been primarily transferred by the transfer rollers 14. The transfer belt unit 40 further includes a driving roller 42 as a second rotation member, a tension roller 43 as a first rotation member, and a backup roller 44. The driving roller 42 is driven by a driving motor 110, and drives the intermediate transfer belt 41 in a belt conveying direction shown by an arrow X corresponding to counterclockwise direction in FIG. 1. The tension roller 43 is provided so as to face the driving roller 42. The intermediate transfer belt 41 is stretched (wound) around the driving roller 42, the tension roller 43 and the transfer roller 15. The backup roller 44 is provided so as to face the transfer roller 15 via the intermediate transfer belt 41.

The transfer belt unit 40 (as the driving unit) includes a correction portion 50 (FIG. 10) at an end of the tension roller 43. The correction portion 50 includes an arm 52, springs 53L and 53R, bearings 54L and 54R, a lever 55 and a pulley 56. Detailed description of these parts will be made later.

A fixing portion 16 is provided on the downstream side of the transfer roller 15 (as the secondary transfer roller). The fixing portion 16 is configured to fix the toner image (i.e., the developer image) to the recording medium P by applying heat and pressure. The fixing portion 16 includes an upper roller 16*a* and a lower roller 16*b* both of which have surface layers made of resilient bodies. The upper roller 16*a* and the lower roller 16*b* have halogen lamps 16*c* and 16*d* (as internal heat sources) therein.

Ejection roller pairs 17*a*, 17*b* and 17*c* are provided on the downstream side of the fixing portion 16. The ejection roller pairs 17*a*, 17*b* and 17*c* eject the recording medium P to the outside of the image forming apparatus 10. A stacker portion 18 is provided on an upper part of the image forming apparatus 10 on which the ejected recording medium P is placed.

The image forming apparatus 10 has a power source 120. The power source 120 supplies electric power for entire operation of the image forming apparatus 10. In particular, the power source 120 applies voltages to the charging rollers 32 (32C, 32M, 32Y, 32K), the developing rollers 34 (34C, 34M, 34Y, 34K), the primary transfer rollers 14 (14C, 14M, 14Y, 14K) and the secondary transfer roller 15.

Figure 2:
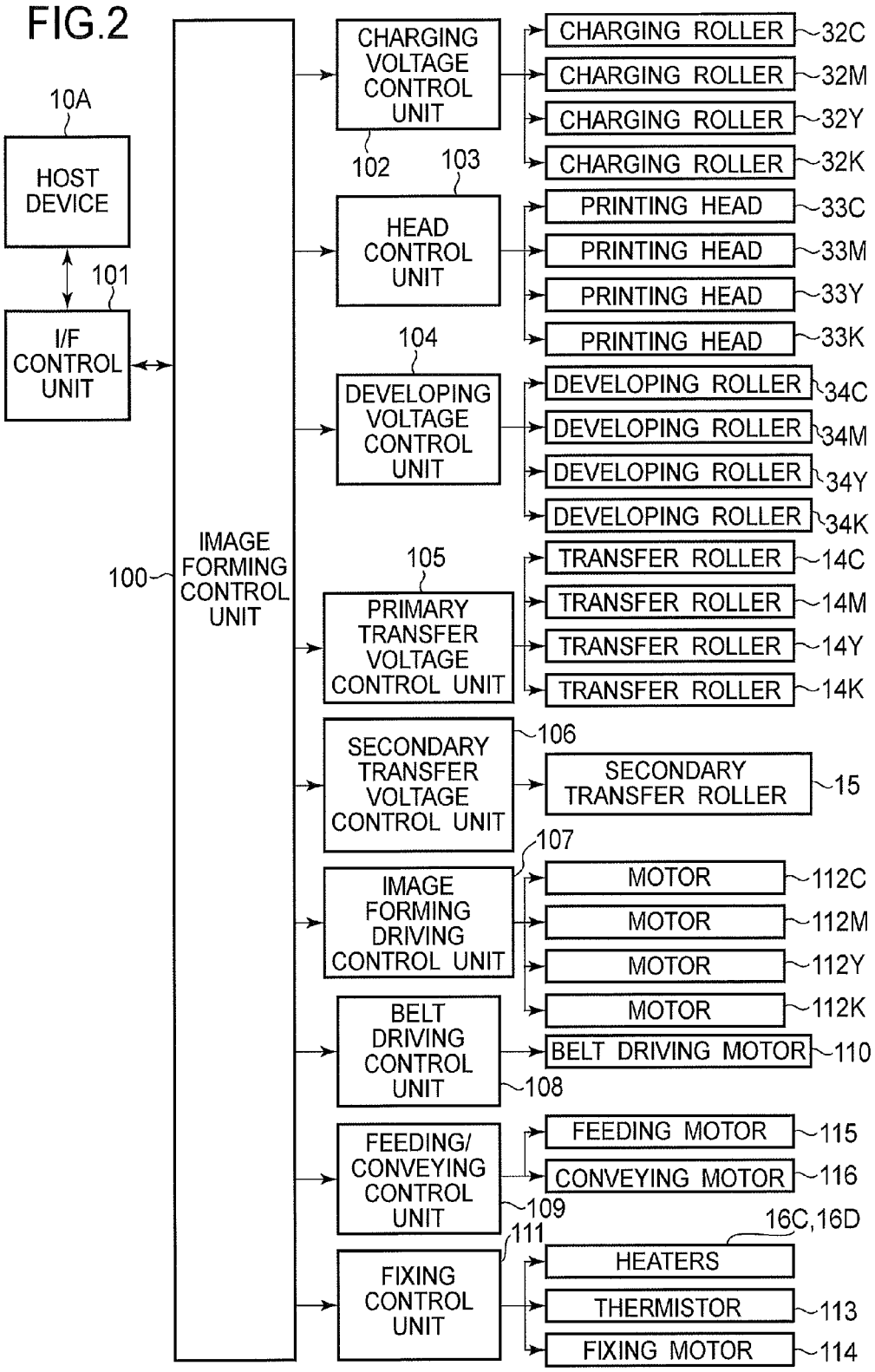
FIG. 2 is a block diagram showing a control system of the image forming apparatus according to the first embodiment.

FIG. 2 is a block diagram showing a control system of the image forming apparatus 10 of the first embodiment.

An image forming control unit 100 as a control unit includes a microprocessor, ROM, RAM, input-output port, timer and the like. The image forming control unit 100 receives image data (print data) and control command from a host device 10A, and performs sequence control of the entire image forming apparatus 10 to thereby perform a printing operation.

An I/F control unit 101 sends printer information to the host device 10A, analyzes command sent from the host device 10A, and processes data sent from the host device 10A.

A charge voltage control unit 102 controls application of voltages to the charging rollers 32 to thereby charge the surfaces of OPC drums 31 according to a command from the image forming control unit 100.

A head control unit 103 controls the printing heads 33 to emit lights to expose the surfaces of the OPC drums 31 according to a command from the image forming control unit 100 so as to form latent images the OPC drums 31.

A developing voltage control unit 104 controls application of voltages to the developing rollers 34 according to a command from the image forming control unit 100 so as to cause the toner (i.e., developer) to adhere to the latent images formed on the surfaces of the OPC drums 31 by the printing heads 33.

A primary transfer voltage control unit 105 controls application of voltages to the (primary) transfer rollers 14 according to a command from the image forming control unit 100 so as to transfer the toner images on the surfaces of the OPC drums 31 to the intermediate transfer belt 41 (as the endless belt or the developer image bearing body).

A secondary transfer voltage control unit 106 controls application of a voltage to the secondary transfer roller 15 according to a command from the image forming control unit 100 so as to transfer the toner image from the intermediate transfer belt 41 to the recording medium P.

An image forming driving control unit 107 controls drive motors 112C, 112M, 112Y, 112K for rotating the OPC drums 31, the charging rollers 32, the developing rollers 34 according to a command from the image forming control unit 100.

A belt driving control unit 108 controls the driving motor 110 according to a command from the image forming control unit 100 so as to rotate the driving roller 42 to move the intermediate transfer belt 41. The rotation of the driving roller 42 is transmitted to the tension roller 43 and the backup roller 44 via the intermediate transfer belt 41, and the tension roller 43 and the backup roller also rotate. The transfer roller 15 contacting the intermediate transfer belt 41 also rotates.

A feeding-conveying control unit 109 controls a feeding motor 115 and a conveying motor 116 according to a command from the image forming control unit 100 so as to feed and convey the recording medium P. In this regard, the feeding motor 115 drives the pickup roller 12*a*, the feeding roller 12*b*, and the conveying roller pairs 13*a* and 13*b*. The conveying motor 116 drives the conveying roller pair 13*c*.

A fixing control unit 111 controls application of voltages to heaters 16*c* and 16*d* of the fixing portion 16 according to a command from the image forming control unit 100 so as to fix the toner image to the recording medium P. More specifically, the fixing control unit 111 receives temperature information from a thermistor 113 for detecting the temperature of the fixing portion 16, and performs ON/OFF control of the heaters 16*c* and 16*d*. Further, the fixing control unit 111 controls a fixing motor 114 according to a command from the image forming control unit 100 so as to rotate the upper and lower rollers 16*a* and 16*b* after the temperature in the fixing portion 16 reaches to a predetermined temperature. The fixing motor 117 drives the upper roller 16*a* of the fixing portion 16 and the ejection roller pairs 17*a*, 17*b* and 17*c*.

Figure 3:
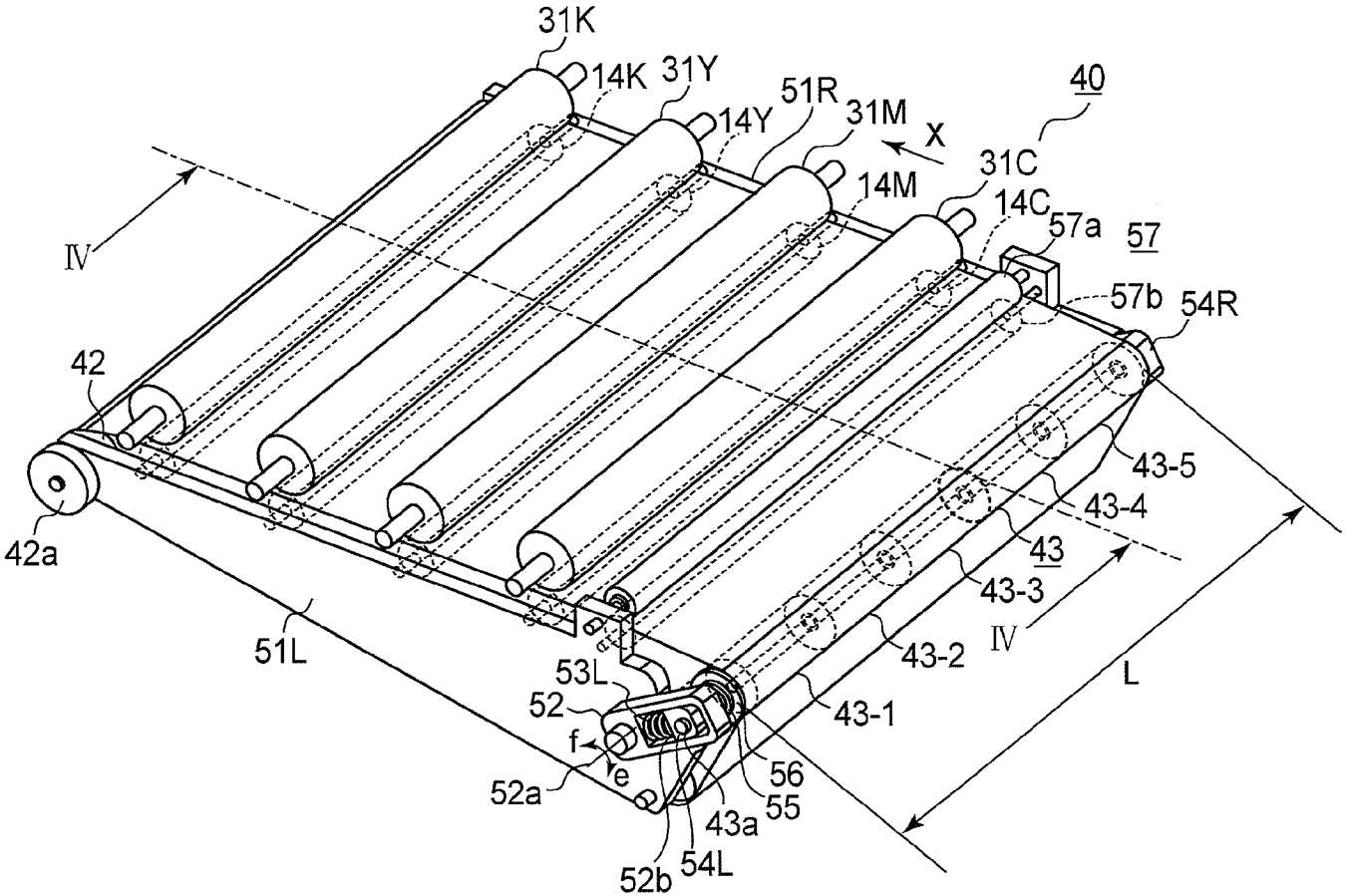
FIG. 3 is a perspective view showing a transfer belt unit according to the first embodiment.
Figure 4:
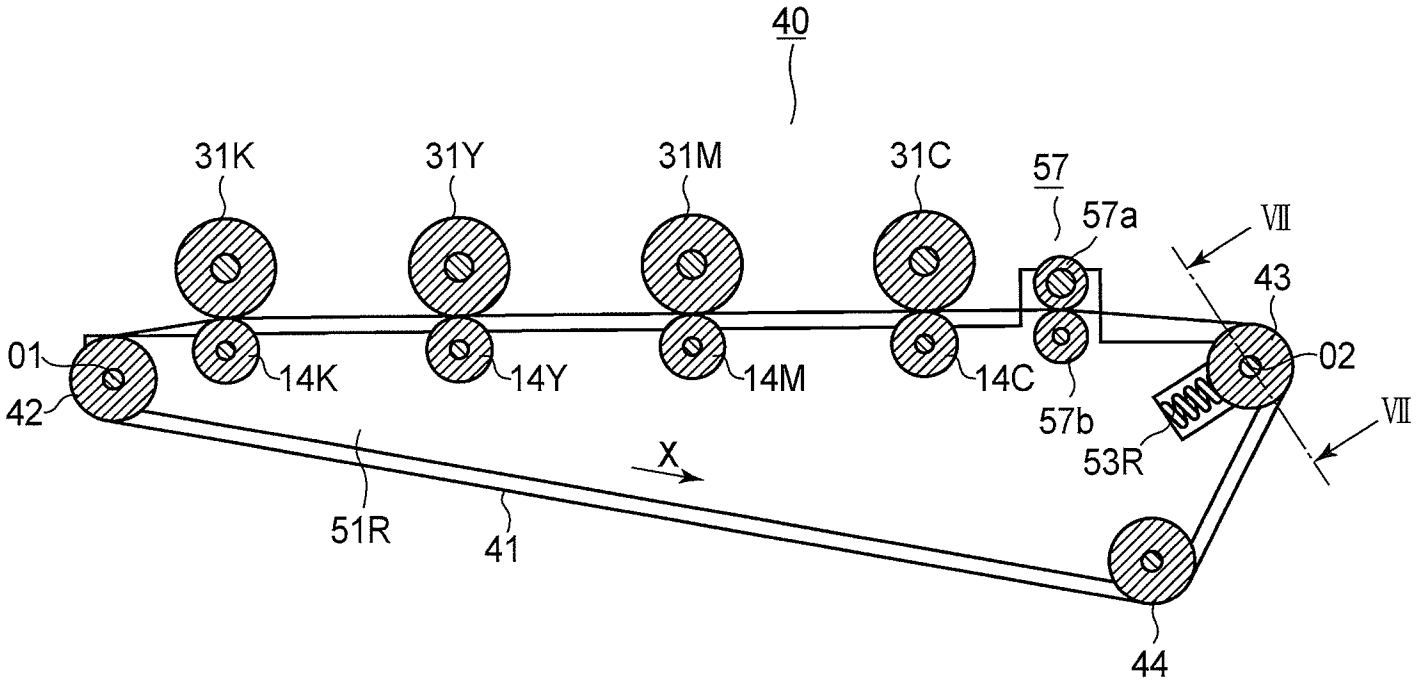
FIG. 4 is a sectional view of the transfer belt unit taken along line IV-IV in FIG. 3.

FIG. 3 is a perspective view showing a basic configuration of the transfer belt unit 40 according to the first embodiment. FIG. 4 is a sectional view taken along line IV-IV in FIG. 3.

The transfer belt unit 40 is configured so that the intermediate transfer belt 41 is stretched around three rollers: the driving roller 42, the tension roller 43 and the backup roller 43 as described above. The driving roller 42 rotates to move the intermediate transfer belt 41*e*. The tension roller 43 has a tension roller shaft 43*a* whose inclination can be changed as described later.

Figure 5:
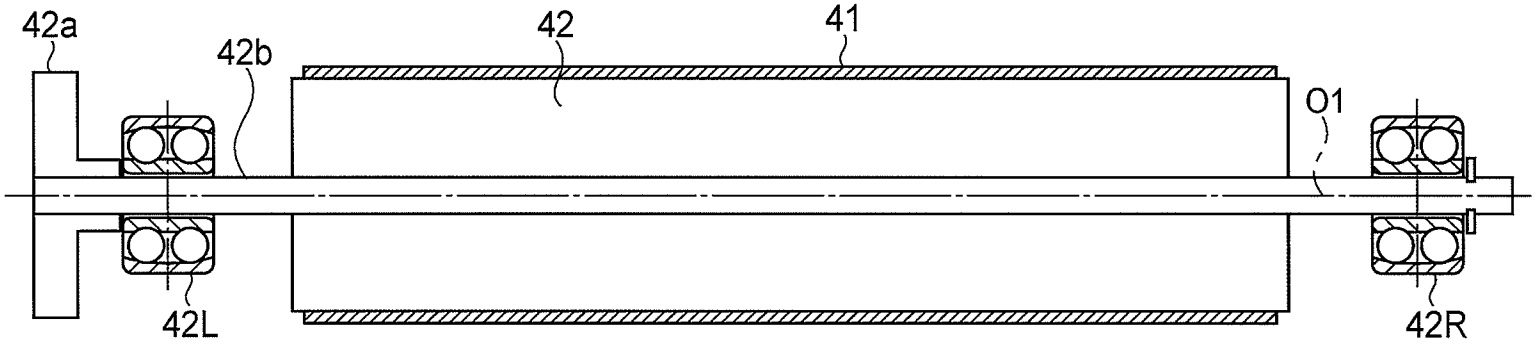
FIG. 5 is a sectional view showing a driving roller according to the first embodiment.

FIG. 5 shows the driving roller 42. As shown in FIG. 5, the driving roller 42 has a driving roller shaft 42*b*. The driving roller shaft 42*b* is rotatably supported by bearings 42L and 42R mounted to frames 51L and 51R (FIG. 3) of the transfer belt unit 40. A driving gear 42*a* is fixed to the driving roller shaft 42*b*. A power of the driving motor 110 is transmitted to the driving gear 42*a*, and the driving roller 42 (with the driving roller shaft 42*b* and the driving gear 42*a*) rotates about a rotation axis O1 as a second rotation axis.

Further, the driving roller 42 is a metal roller made of aluminum covered with a ceramic coating layer. When the driving roller 42 rotates, the intermediate transfer belt 41 rotates due to a friction between the driving roller 42 and the intermediate transfer belt 41.

As shown in FIG. 4, the backup roller 44 is located on a downstream side of the driving roller 42 in the belt conveying direction X. The backup roller 44 is made of aluminum, and is rotatably supported by the bearings 45L and 45R mounted to the frames 51L and 51R (FIG. 3).

The tension roller 43 is located on a downstream side of the backup roller 44 in the belt conveying direction X. The tension roller 43 has the tension roller shaft 43*a* rotatable about a rotation axis O2 as a first rotation axis. As shown in FIG. 3, the tension roller 43 is divided into a plurality of (for example, five) roller parts 43-1, 43-2, 43-3, 43-4 and 43-5 in an axial direction of the tension roller shaft 43*a*. That is, the tension roller 43 as the first rotation member includes a plurality of roller parts 43-1, 43-2, 43-3, 43-4 and 43-5 as a plurality of divided rollers (or segment rollers) in the axial direction of the rotation axis O2 of the tension roller shaft 43*a*.

Figure 6:
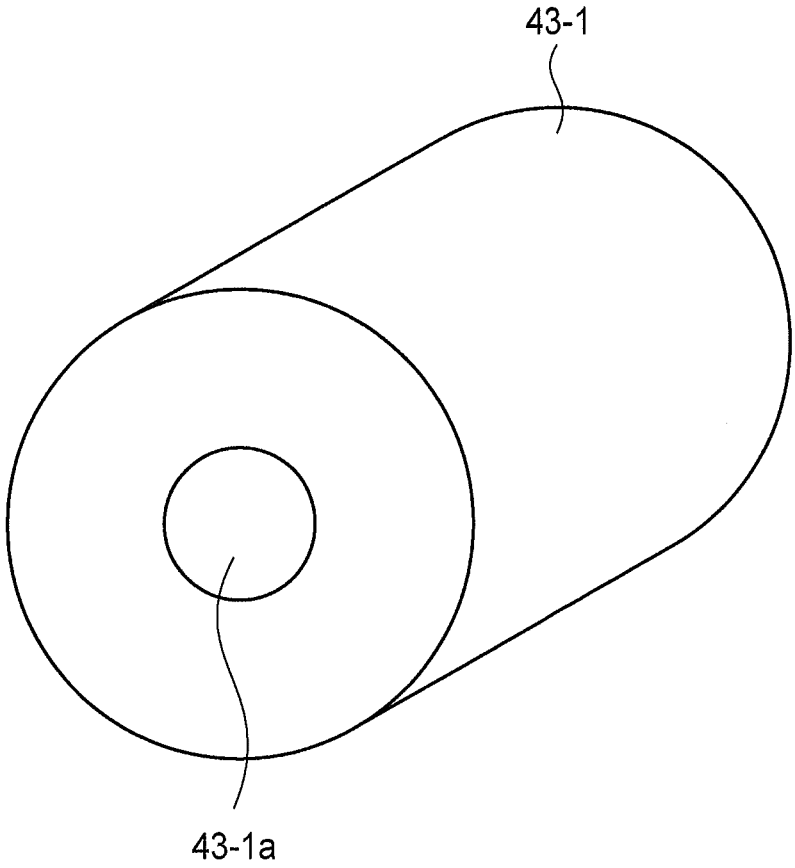
FIG. 6 is a perspective view showing a roller part of a tension roller according to the first embodiment.

FIG. 6 is a perspective view showing the roller part 43-1 among the roller parts 43-1 through 43-5 of the tension roller 43 of FIG. 3. The roller parts 43-1 through 43-5 have engaging holes (i.e., center holes) through which the tension roller shaft 43*a* penetrates.

Therefore, the roller parts 43-1 through 43-5 are independently rotatable about the tension roller shaft 43*a*. Further, the roller parts 43-1 through 43-5 are mounted to the tension roller shaft 43*a* using e-rings 58 so as not to move in the axial direction of the tension roller shaft 43*a* (FIGS. 7A, 7B and 7C).

Figures 7A, 7B, 7C:
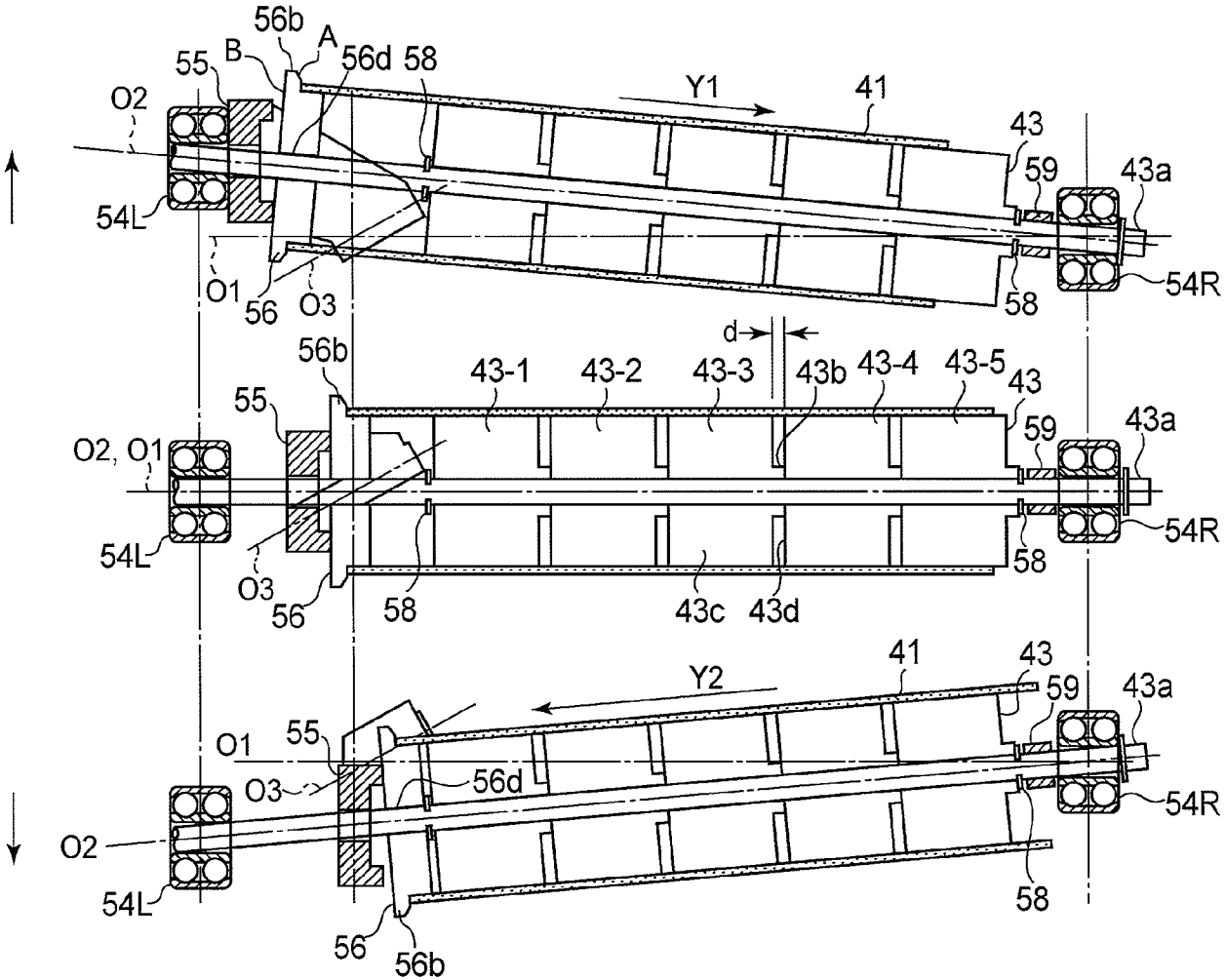
FIGS. 7A, 7B and 7C are sectional views of the tension roller taken along line VII-VII in FIG. 4.

FIGS. 7A, 7B and 7C are sectional views taken along line VII-VII in FIG. 3.

As shown in FIG. 7A, a pulley 56 as a third rotation member is mounted to an end of the tension roller shaft 43*a*. The pulley 56 has a flange portion 56*b* as a contact portion (i.e., a belt contact portion) with a surface A that contacts a lateral end (i.e., a widthwise end) of the intermediate transfer belt 41. The pulley 56 has a engaging hole 56 through which the tension roller shaft 43*a* penetrates. The pulley 56 is slidable along the tension roller shaft 43*a*, i.e., movable in the direction of the rotation axis O2. The pulley 56 has a surface B opposite to the surface A. The surface B of the pulley 56 contacts a lever 55 (as a shaft shifting member). The lever 55 is mounted to the frame 51L so as to be rotatable about a rotation axis O3 as a third rotation axis inclined with respect to the rotation axis O2.

A bearing 54L is provided on the same end of the tension roller shaft 43*a* as the pulley 56. As shown in FIG. 3, an arm 52 is rotatably mounted to the frame 51L so as to be rotatable about a rotation axis 52*a*. The bearing 54L is mounted in a rail portion 52*b* formed on the arm 52 so as to be slidable in a longitudinal direction of the rail portion 52*b*.

A spring 53L is provided between the bearing 54L and an inner wall of the rail portion 52*b* of the arm 52. The spring 53L is constituted by a compression coil spring, and presses the bearing 54L to apply a tension to the intermediate transfer belt 41.

A bearing 54R is provided on an end of the tension roller shaft 43*a* opposite to the pulley 56. The bearing 54R is slidably mounted in a rail portion (not shown) formed on the frame 51R. A spring 53R (FIG. 4) is provided between the bearing 54R and an inner wall of the rail portion of the frame 51R (FIG. 2). The spring 53R is constituted by a compression coil spring, and presses the bearing 54R to apply a tension to the intermediate transfer belt 41.

As shown in FIG. 4, a belt regulation roller pair 57 as a belt regulating unit is provided on a downstream side of the tension roller 43 in the belt conveying direction X. The belt regulation roller pair 57 includes rollers 57*a* and 57*b* provided so as to nip the intermediate transfer belt 41 therebetween. Both ends of the roller 57*a* are rotatably supported by not shown bearings mounted to the frame 51L and 51R. Similarly, both ends of the roller 57*b* are rotatably supported by not shown bearings mounted to the frame 51L and 51R. The rollers 57*a* and 57*b* regulate a trajectory of movement of the intermediate transfer belt 41.

The transfer rollers 14 (14C, 14M, 14Y, 14K) as first primary transfer members are provided on a downstream side of the belt regulation roller pair 57 in the belt conveying direction X. Each of the transfer rollers 14 is rotatably supported by not shown bearings mounted to the frames 51L and 51R. The transfer rollers 14 are pressed against the OPC drums 31C, 31M, 31Y and 31K via the intermediate transfer belt 41 by a pressing unit (not shown).

As shown in FIG. 7A, an e-ring 58 and a spacer 59 are provided between the roller part 43-5 and the bearing 54R. Further, another e-ring 58 is provided between the roller part 43-1 and the bearing 54L. The e-rings 58 and the spacer 59 constitute a regulating member that regulates the axial movement of the roller parts 43-1 through 43-5 in the axial direction of the tension roller 43. The pulley 56 has the flange portion 56*b* that contacts the lateral end of the intermediate transfer belt 41 as described above. The lever 55 contacts the surface B of the pulley 56 opposite to the intermediate transfer belt 41. The lever 55 is mounted to the frame 51L so as to be rotatable about the rotation axis O3 as the third rotation axis.

The roller parts 43-1, 43-2, 43-3, 43-4 and 43-5 of the tension roller 43 are rotatably supported by the tension roller shaft 43*a*. Gaps "d" are formed between adjacent roller parts 43-1 through 43-5 in the axial direction of the rotation axis O2 of the tension roller 43 so as to suppress generation of a friction force.

As shown in FIG. 7B, the gaps "d" are formed by providing ring-shaped boss portions 43*b* (i.e., abutting portions) on the roller parts 43-1 through 43-5. Each boss portion 43*b* has a smaller diameter than a belt stretching portion 43*c* (of each tension roller 43) around which the intermediate transfer belt 41 is stretched. The boss portions 43*b* of the respective roller parts 43-1 through 43-4 abut against to-be-abutted portions 43*d* of the adjacent roller parts 43-2 through 43-5.

In this embodiment, the roller parts 43-1 through 43-5 have the same shapes in order to contribute to reducing manufacturing cost. Therefore, the roller parts 43-1 through 43-5 have the boss portions 43*b* (i.e., the abutting portions) on the same side, which abut against the to-be-abutted portions 43*d* of the adjacent roller part. However, this embodiment is not limited to such a configuration. For example, it is also possible that each of the roller parts 43-2 and 43-4 has two boss portions 43*b* on both sides, and each of the roller parts 43-1, 43-3 and 43-5 has two to-be-abutted portions 43*d* on both sides. With such a configuration, the above described gap "d" can be formed between the adjacent roller parts 43-1 through 43-5, and therefore generation of a friction force can be suppressed.

The tension roller 43 is supported by engagement of the tension roller shaft 43*a* and the bearings 54L and 54R. The tension roller 43 is prevented from moving toward the bearing 54R by the e-ring 58 and the spacer 59. Further, the tension roller 43 is prevented from moving toward the bearing 54L by the e-ring 58. The bearings 54L and 54R have self-aligning function, and are configured to follow the inclination of the tension roller 43.

In a state shown in FIG. 7B, the rotation axis O2 of the tension roller 43 is parallel to the rotation axis O1 of the drive roller 42. In this state, the intermediate transfer belt 41 moves stably.

In a state shown in FIG. 7A, the rotation axis O2 of the tension roller 43 is inclined upward with respect to the rotation axis O1 of the drive roller 42. In this state, the lever 55 rotates about the rotation axis O3, and reaches the vicinity of the bearing 54L.

In a state shown in FIG. 7C, the rotation axis O2 of the tension roller 43 is inclined downward with respect to the rotation axis O1 of the drive roller 42. In this state, the lever 55 rotates about the rotation axis O3 to press the pulley 56, and reaches a position closer to the bearing 54R.

Figure 8:
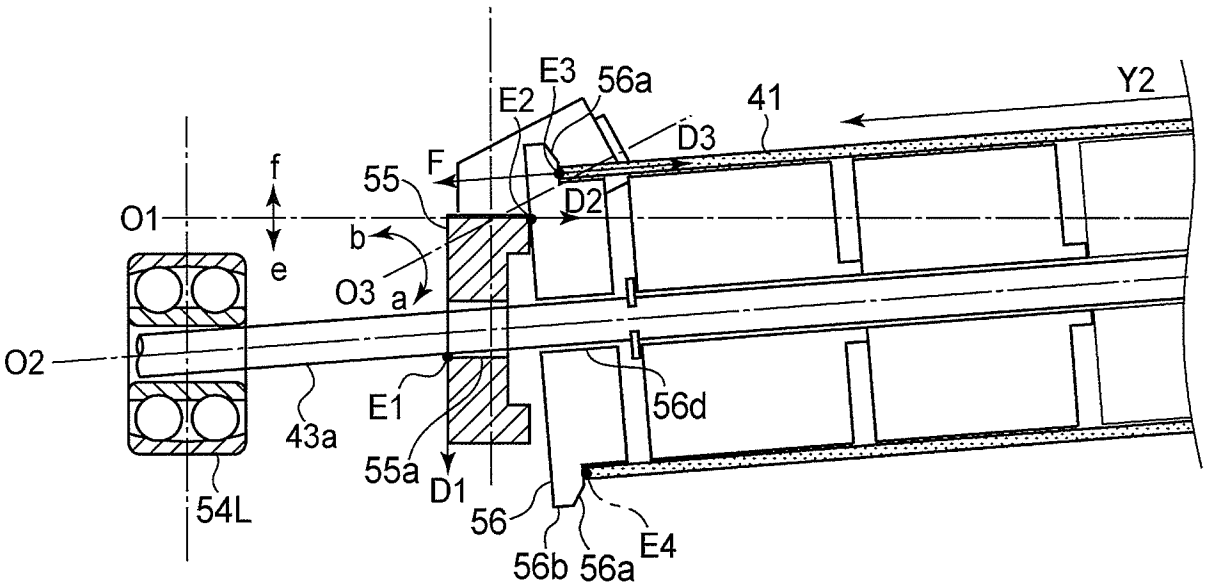
FIG. 8 is an enlarged view showing a configuration at an end of the tension roller according to the first embodiment.

FIG. 8 is an enlarged view showing a configuration at the end of the tension roller 43 on the pulley 56 side. In FIG. 8, the rotation axis O2 of the tension roller 43 is inclined downward with respect to the rotation axis O1 of the driving roller 42 as shown in FIG. 7C. According to the inclination of the tension roller 43, the lever 55 rotates about the rotation axis O3 in a direction shown by an arrow "a", and presses the pulley 56 in a direction shown by an arrow D2.

The flange portion 56*b* (i.e., the contact portion) of the pulley 56 has a tapered portion 56*a*. When the intermediate transfer belt 41 is going to pass over the flange 56*b*, the tapered portion 56*a* guides the intermediate transfer belt 41 to its original position.

Figure 9A:
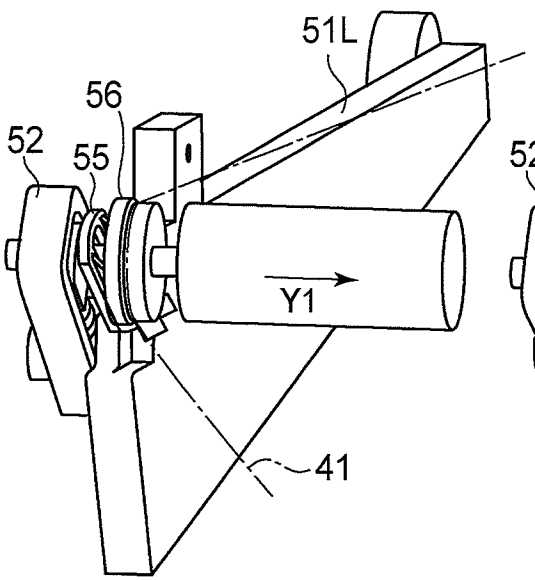
FIGS. 9A, 9B and 9C are schematic views showing an operation, of the configuration at the end of the tension roller according to the first embodiment.
Figure 9B:
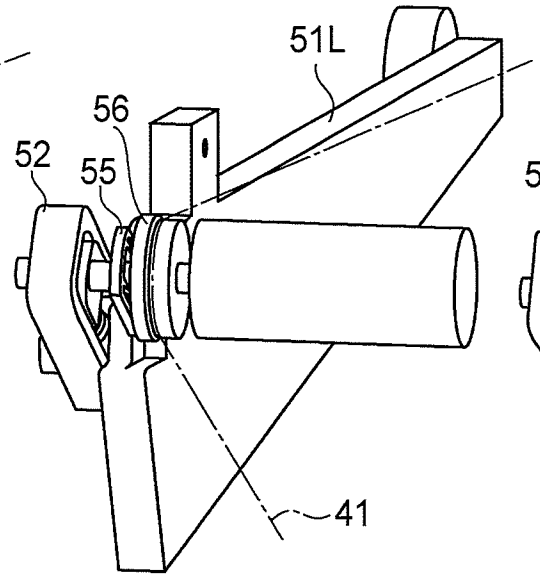
Figure 9C:
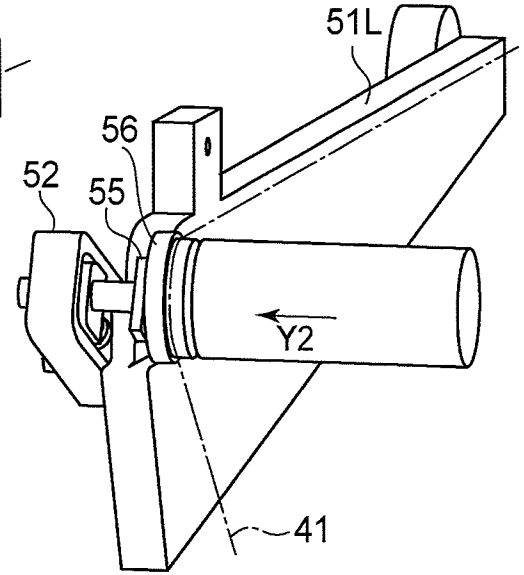

FIGS. 9A, 9B and 9C are perspective views showing an operation of the configuration at the end of the tension roller 43.

FIG. 9B shows a state in which the rotation axis O2 of the tension roller 43 is parallel to the rotation axis O1 of the drive roller 42 as shown in FIG. 7B. In this state, the intermediate transfer belt 41 moves stably.

FIG. 9A shows a state in which the rotation axis O2 of the tension roller 43 is inclined upward with respect to the rotation axis O1 of the driving roller 42 as shown in FIG. 7A. In this state, the lever 55 rotates about the rotation axis O3 (FIG. 8), and contacts the arm 52.

FIG. 9C shows a state in which the rotation axis O2 of the tension roller 43 is inclined downward with respect to the rotation axis O1 of the driving roller 42 as shown in FIG. 7C. In this state, the lever 55 rotates about the rotation axis O3 (FIG. 8) to press the pulley 56, so that the intermediate transfer belt 41 and the tension roller 43 are moved toward the bearing 54R.

Figure 10:
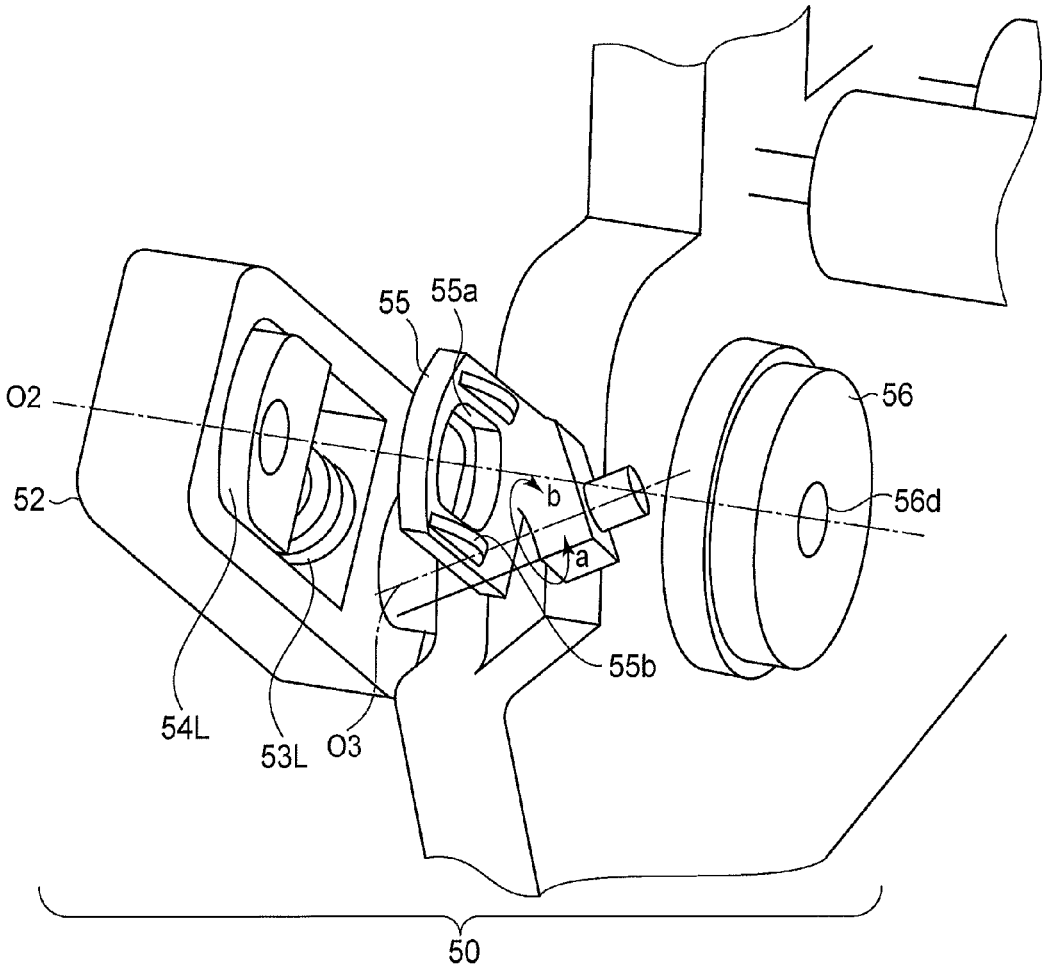
FIG. 10 is an exploded perspective view showing the configuration at the end of the tension roller according to the first embodiment.

FIG. 10 is a perspective view showing the configuration at the end of the tension roller 43 shown in FIGS. 9A through 9C.

The lever 55 has the rotation axis O3 inclined at a predetermined angle with respect to the rotation axis O2 of the tension roller 43. The lever 55 has an elongated hole 55*a* of substantially oval shape. The tension roller shaft 43*a* (omitted in FIG. 10) penetrates the elongated hole 55*a*, and is rotatably and slidably held in the elongated hole 55*a*. The lever 55 has convex portions 55*b* facing the pulley 56, and the convex portions 55*b* are able to contact the pulley 56. The above described bearing 54L and the spring 53L are provided in the rail portion 52*b* of the arm 52.

The lever 55 has the rotation axis O3 inclined with respect to the rotation axis O2 of the tension roller 43. Therefore, when the left end (i.e., the pulley 56 side) of the tension roller 43 is shifted downward as shown in FIG. 7C, the lever 55 rotates downward and toward the tension roller 43, and presses the pulley 56.

When the left end (i.e., the pulley 56 side) of the tension roller 43 is shifted upward as shown in FIG. 7A, the lever 55 rotates upward and away from the tension roller 43.

Figures 11A, 11B, 11C, 11D:
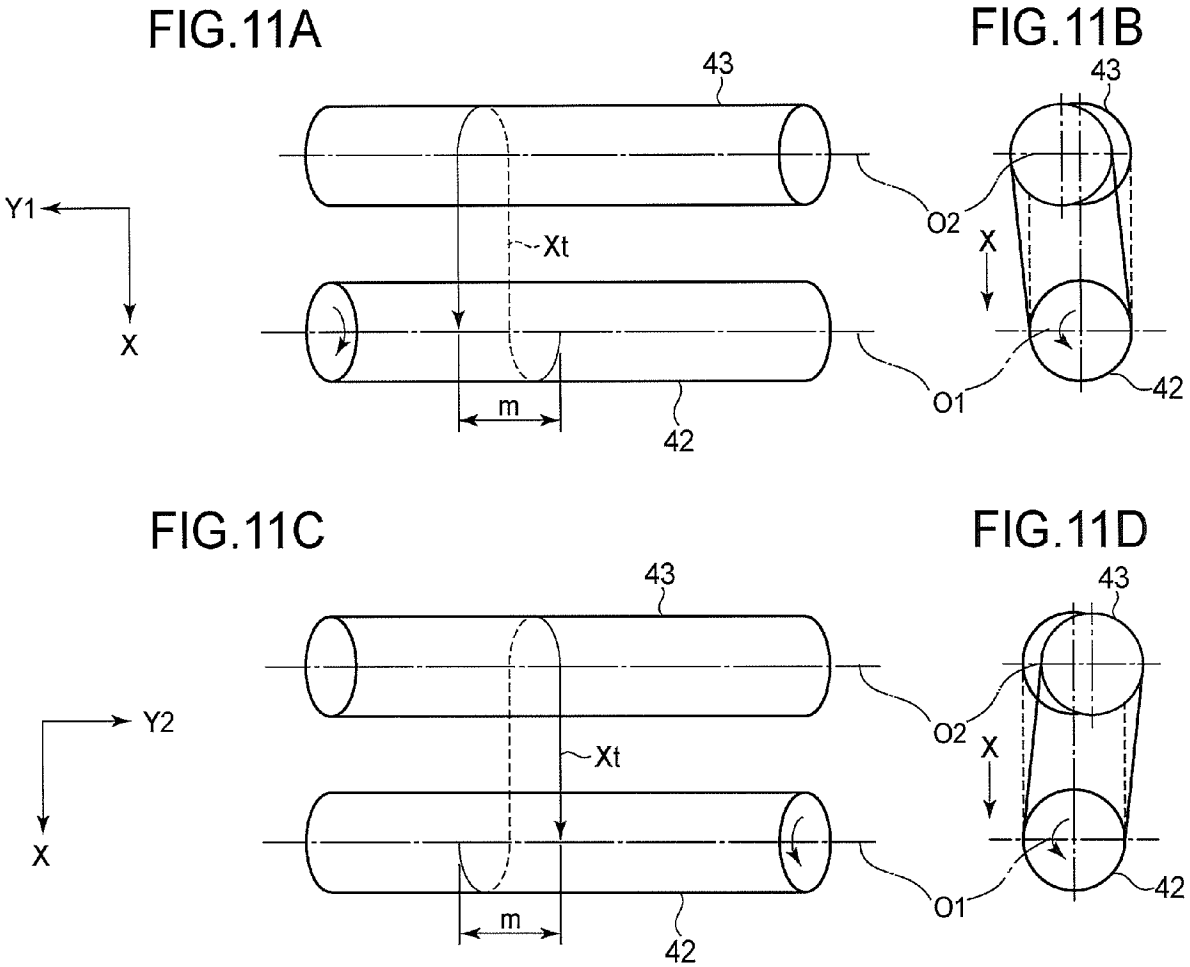
FIGS. 11A, 11B, 11C and 11D are schematic views for illustrating a skew of an intermediate transfer belt.

FIGS. 11A, 11B, 11C and 11D are schematic views for illustrating the skew of the intermediate transfer belt 41 shown in FIG. 4. FIGS. 11A and 11C are plan views schematically showing a trajectory Xt of the intermediate transfer belt 41 together with the driving roller 42 and the tension roller 43. In FIGS. 11A and 11C, left and right sides are reversed with respect to FIGS. 7A through 7C. FIGS. 11B and 11D are side views schematically showing a trajectory Xt of the intermediate transfer belt together with the driving roller 42 and the tension roller 43.

The intermediate transfer belt 41 is moved (rotated) by the driving roller 42 in the belt conveying direction X. If the driving roller 42, the tension roller 43 an the backup roller 43 are not exactly parallel to one another, the intermediate transfer belt 41 may skew in a direction perpendicular to the belt conveying direction X when the intermediate transfer belt 41 moves.

For example, when the right end (i.e., the pulley 56 side) of the tension roller 43 shifts upward as shown in FIGS. 11A and 11B, the intermediate transfer belt 41 moves along the trajectory Xt shown in FIG. 11A due to tendency of the intermediate transfer belt 41 to move perpendicularly to the axial direction of the tension roller 43. As a result, the intermediate transfer belt 41 skews in a belt skew direction Y1 perpendicular to the belt conveying direction X. By one rotation of the driving roller 43, the intermediate transfer belt 41 skews in the belt skew direction Y1 by an amount "m" shown in FIG. 11A. In FIG. 11A, a solid line indicates the trajectory Xt above the driving roller 42 and the tension roller 43, and a dashed line indicates the trajectory Xt below the driving roller 42 and the tension roller 43.

In contrast, when the right end (i.e., the pulley 56 side) of the tension roller 43 shifts downward as shown in FIGS. 11C and 11D, the intermediate transfer belt 41 skews in a belt skew direction Y2 as shown in FIG. 11C.

The skew of the intermediate transfer belt 41 is caused by a non-parallelism of the driving roller 42, the tension roller 43 and the backup roller 44, an unevenness of the tension of the intermediate transfer belt 41 (for example, a difference in biasing force between springs 53L and 53R at both ends of the tension roller shaft 43*a*), a difference in circumferential length between both lateral ends of the intermediate transfer belt 41, a cylindrically of each of the rollers around which the intermediate transfer belt 41 is stretched (i.e., the driving roller 42, the tension roller 43 and the backup roller 44), and the like.

<Entire Operation>

An entire operation of the image forming apparatus 10 will be described with reference to FIGS. 1 and 2.

In FIG. 1, the image forming control unit 100 of the image forming apparatus receives image data from the host device 10A via the I/F control unit 101, and starts an image forming operation. The image forming control unit 100 causes the feeding-conveying control unit 109 to drive the feeding motor 115. The pickup roller 12*a* of the medium feeding unit 12 is driven by the feeding motor 115, and picks up the recording medium P from the medium tray 11. The recording medium P picked up by the pickup roller 12*a* reaches a nip portion between the feeding roller 12*b* and the retard roller 12*c*, and is separately fed.

The recording medium P fed by the medium feeding unit 12 then reaches the medium conveying unit 13, and conveyed by the conveying roller pairs 13*a*, 13*b* and 13*c* to reach the transfer roller 15 as the secondary transfer portion.

The charging rollers 32 (32C, 32M, 32Y, 32K) are applied with negative voltage (for example, −1000V) by the charge voltage control unit 102, and charge the surfaces of the OPC drums 31 (31C, 31M, 31Y, 31K) to negative potential (for example, −600V). The head control unit 103 causes the printing heads 33 (33C, 33M, 33Y, 33K) to expose the surfaces of the OPC drums 31 (31C, 31M, 31Y, 31K) according to the image data sent from the host device 10A so as to form latent images on the OPC drums 31.

The developing rollers 34 (34C, 34M, 34Y, 34K) are applied with negative voltage (for example, −200V) by the developing voltage control unit 104, and develop the latent images on the OPC drums 31 (31C, 31M, 31Y, 31K) using the toners supplied by the toner supply units 35 (35C, 35M, 35Y, 35K) so as to form toner images (i.e., visualized images) as developer images. The transfer rollers 14 (14C, 14M, 14Y, 14K) as the primary transfer portions are applied with positive voltage (for example, +1500V) by the primary transfer voltage control unit 105. The toner images formed on the OPC drums 31 (31C, 31M, 31Y, 31K) are transferred to the intermediate transfer belt 41 at the nip portions between the OPC drums 31 and the transfer rollers 14, so that the charged toner image is formed on the intermediate transfer belt 41. In this regard, the backup roller 44 is connected to a frame ground (i.e., grounded).

The OPC drums 31 of the toner image forming units 30 (30C, 30M, 30Y, 30K) and the intermediate transfer belt 41 are driven in synchronization with each other under control of the image forming control unit 100, and toner images of the respective colors are transferred to the intermediate transfer belt 41. The toner image formed on the intermediate transfer belt 41 is carried to the transfer roller 15 as the secondary transfer portion by the intermediate transfer belt 41. The transfer roller 15 is applied with positive voltage (for example, +3000V) by the secondary transfer voltage control unit 106. The toner image is transferred from the intermediate transfer belt 41 to the recording medium P by electric field formed by the transfer roller 15 and the grounded backup roller 44.

The recording medium P (to which the toner image has been transferred by the transfer roller 15) is conveyed to the fixing portion 16. The fixing portion 16 applies heat and pressure to the recording medium P so as to melt and fix the toner image to the recording medium P. Then, the recording medium P is ejected by the ejection roller pairs 17*a*, 17*b* and 17*c* to the stacker portion 18.

<Operation of Transfer Belt Unit>

An operation of the transfer belt unit 40 according to the first embodiment will be described with reference to FIGS. 7A through 10.

There is a case where the tension roller 43 is inclined as shown in FIG. 7C, due to flatness of an installation surface of the image forming apparatus 10, a deflection of the frames 51L and 51R, an assembly error, a dimensional error or the like. In such a case, as shown in FIG. 8, the tension roller shaft 43*a* of the tension roller 43 is also inclined, and therefore the lever 55 (with the elongated hole 55*a* through which the tension roller shaft 43 penetrates) contacts the tension roller shaft 43 at a position E1 on a periphery of the elongated hole 55*a*. The lever 55 is applied with a force in a direction shown by an arrow D1 (i.e., downward) at the position E1. Therefore, the lever 55 rotates in a direction indicated by an arrow "a" about the rotation axis O3 fixed to the frame 51L.

The pulley 56 is provided between the lever 55 and the tension roller 43 so as to be movable along the tension roller 43*a* in the axial direction. When the lever 55 rotates in the direction indicated by the arrow "a", the lever 55 contacts the pulley 56 at the position E2. As the lever 55 contacts the pulley 56, the lever 55 applies a force to the pulley 56 in a direction indicated by an arrow D2. Therefore, the pulley 56 slides along the tension roller shaft 43*a* substantially in the direction indicated by the arrow D2.

The intermediate transfer belt 41 contacts the flange portion 56*b* of the pulley 56 at a position E3. When the pulley 56 moves along the tension roller shaft 43*a*, the intermediate transfer belt 41 is applied with a force in a direction indicated by an arrow D3 at the position E3. Therefore, the intermediate transfer belt 41 is moved toward the bearing 54R side.

In this state, when the driving motor 110 starts rotating the driving roller 42, the intermediate transfer belt 41 and the tension roller 43 rotate accompanying the rotation of the driving roller 42. Accordingly, the intermediate transfer belt 41 skews in the belt skew direction Y2 (see FIG. 11C), and the intermediate transfer belt 41 presses the pulley 56 having the flange 56*b* contacting the lateral end of the intermediate transfer belt 41 at the positions E3 and E4 as shown in FIG. 8. The intermediate transfer belt 41 presses the pulley 56 with a force F in a direction opposite to the direction D3.

As a result, the pulley 56 slides along the tension roller shaft 43*a* in the axial direction, i.e., the belt skew direction Y2. As the pulley 56 slides along the belt skew direction Y2, the lever 55 is pressed in a direction opposite to the direction D2, and the lever 55 rotates in a direction indicated by an arrow b. As the lever 55 rotates, the tension roller shaft 43*a* is pressed by the elongated hole 55*a* of the lever 5 to move in a direction (i.e., upward) opposite to the direction D1.

In this state, the arm 52 (FIG. 3) supporting the bearing 54L rotates in a direction indicated by an arrow f about the rotation axis 52*a*, and the bearing 54L moves toward a position shown in FIG. 7B. Theoretically, the intermediate transfer belt 41 stably moves in the state shown in FIG. 7B. Practically, the intermediate transfer belt 41 stably moves in a state where weights of the intermediate transfer belt 41 and the arm 52, friction forces between the respective parts and the like are balanced.

In the state shown in FIG. 7B, rotation axis O2 of the tension roller 43 is substantially parallel to the rotation axis O1 of the driving roller 42. Therefore, if the rotation axis O1 of the driving roller 42 is parallel to the rotation axis of the backup roller 44, the skew of the intermediate transfer belt 41 decreases, and the intermediate transfer belt 41 stably moves in the state shown in FIG. 7B.

In contrast, when the tension roller 43 is inclined as shown in FIG. 7A, the intermediate transfer belt 41 skews in a direction indicated by a belt skew direction Y1, and the pulley 56 moves in the belt skew direction Y1. The lever 55 rotates downward about the rotation axis O3, and the convex portions 55*b* press the pulley 56 downward, so that the pulley 56 moves toward the position shown in FIG. 7B. The intermediate transfer belt 41 stably moves in this state.

The inclination operation of the tension roller 43 has been described with reference the operation from FIG. 7C to FIG. 7B (i.e., case 1), and the operation from FIG. 7A to FIG. 7B (i.e., case 2). Regardless of the direction in which the tension roller 43 is inclined, the lever 55 causes the tension roller 43 to be inclined so as to correct the skew of the intermediate transfer belt 41.

For example, even if the intermediate transfer belt 41 and the tension roller 43 are not correctly mounted to predetermined positions in an assembling process of the transfer belt unit 30, the intermediate transfer belt 41 is brought into a state where the intermediate transfer belt 41 stably moves without skew) due to thrust forces acting on the pulley 56 and the lateral end of the intermediate transfer belt 41 in the belt skew directions Y1 and Y2, once the intermediate transfer belt 41 starts to move.

As described above, the rotation axis O2 of the tension roller 43 and the rotation axis O1 of the driving roller 42 and the rotation axis of the backup roller 44 become substantially parallel, and the skew of the intermediate transfer belt 41 is reduced, with the result that the intermediate transfer belt 41 stably moves without skew. In this state, the lateral end of the intermediate transfer belt 41 and the pulley 56 can be kept in contact with each other with a small contact force.

Next, a description will be made of a friction force (load) between the inner circumferential surface of the intermediate transfer belt 41 and the outer surface of the tension roller 43 during the inclination operation of the tension roller 43 with reference to FIGS. 12, 13 and 14.

Hereinafter, the axial direction of the tension roller 43 (which is the same as the widthwise direction of the intermediate transfer belt 41) will be also referred to as a widthwise direction.

Figure 12:
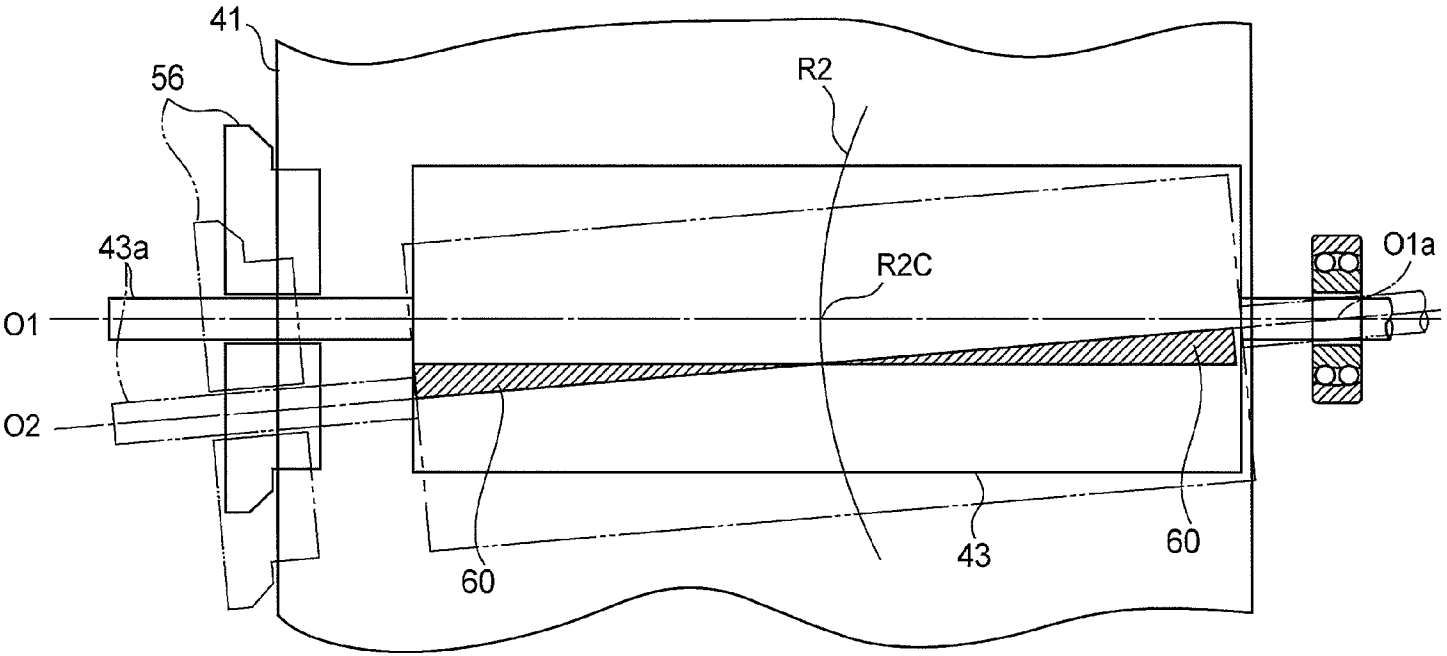
FIG. 12 is a schematic view showing an inclination operation of a tension roller.

FIG. 12 is a schematic view showing a state of the inner circumferential surface of the intermediate transfer belt 41 and the outer surface of the tension roller 43 when the tension roller 43 is inclined. The tension roller 43 of FIG. 12 is not divided into a plurality of roller parts.

When the tension roller 43 is inclined about a inclination center (i.e., fulcrum) O1*a*, the tension roller is rotated by contact with the inner circumferential surface of the intermediate transfer belt 41. Since the tension roller 43 has a length extending over a large portion of the width of the intermediate transfer belt 41, a slippage occurs between the outer surface of the tension roller 43 and the inner circumferential surface of the intermediate transfer belt 41.

In this state, there is a difference in slippage amount between a position closer to the inclination center O1*a* and a position farther from the inclination center O1*a*. When a widthwise center R2C of the tension roller 43 (i.e., a center in the axial direction of the tension roller 43) rotates along a trajectory R2 about the inclination center O1*a*, the outer surface of the tension roller 43 and the inner circumferential surface of the intermediate transfer belt 41 rotate relative to each other about the widthwise center R2C to form slippage portions 60 (on the assumption that no slippage occurs at the widthwise center R2C).

That is, a friction force is generated between the inner circumferential surface of the intermediate transfer belt 41 and the outer surface of the tension roller 43. In such a case, the inclination operation of the tension roller 43 is not smoothly performed, and the skew correction (having been described with reference to FIGS. 7A through 9C) is not satisfactorily performed.

Figure 13:
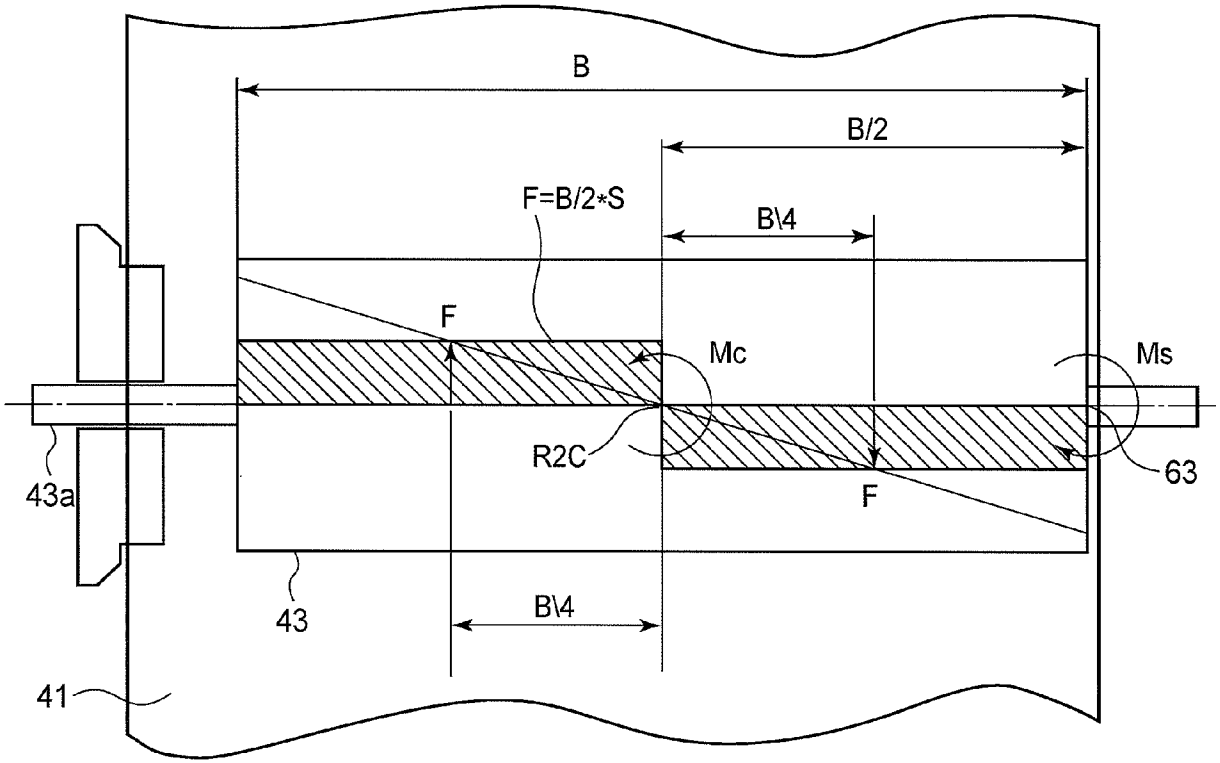
FIG. 13 is a schematic view showing the inclination operation of the tension roller.

FIG. 13 is a schematic view showing a state where a slippage occurs at the widthwise center R2C of the tension roller 43 in such a manner that the outer surface of the tension roller 43 rotates relative to the inner circumferential surface of the intermediate transfer belt 41. The tension roller 43 of FIG. 13 is not divided into a plurality of roller parts.

In FIG. 13, a width of a roller body (i.e., except the tension roller shaft 43*a*) of the tension roller 43 is expressed as B. The friction force between the outer surface of the driving roller 43 and the inner circumferential surface of the intermediate transfer belt 41 per unit length is expressed as S. Here, it is assumed that a stretching force and a friction force applied to the tension roller 43 in the width direction due to the tension of the intermediate transfer belt 41 are both constant. A moment generated at the widthwise center R2C of the tension roller 43 is expressed as Mc. A moment generated at a center O3*a* (i.e., right end center O3*a*) at the right end of the tension roller 43 is expressed as Ms. Here, it is assumed that the right end center O3*a* is an inclination center of the tension roller 43. A friction force between the outer surface of the tension roller 43 and the inner circumferential surface of the intermediate transfer belt 41 is expressed as F.

The friction force generated equally at both left and right portions of the tension roller 43 is expressed as follows:

$$F=(B/2)\times S \tag{1}$$

This friction force F is generated at left and right portions each at a distance r=B/4 from the widthwise center R2C of the tension roller 43, assuming that the friction force is evenly distributed in the widthwise direction. The moment Mc is expressed as follows:

$$Mc=2\times F\times r$$

$$Mc=(1/4)\times B^2\times S \tag{2}$$

A distance r from the widthwise center R2C to the right end center O3*a* is set to 2/L (i.e., r=L/2). Using the distance r, the moment Ms about the right end center O3*a* is expressed as follows:

$$Ms=Mc/r$$

$$Ms=(2/B)\times Mc$$

$$Ms=(1/2)\times B\times S \tag{3}$$

Next, description will be made of the friction force between the inner circumferential surface of the intermediate transfer belt 41 and the outer surface of the tension roller 43 according to the first embodiment, i.e., the tension roller 43 which is evenly divided in five roller parts.

Figure 14:
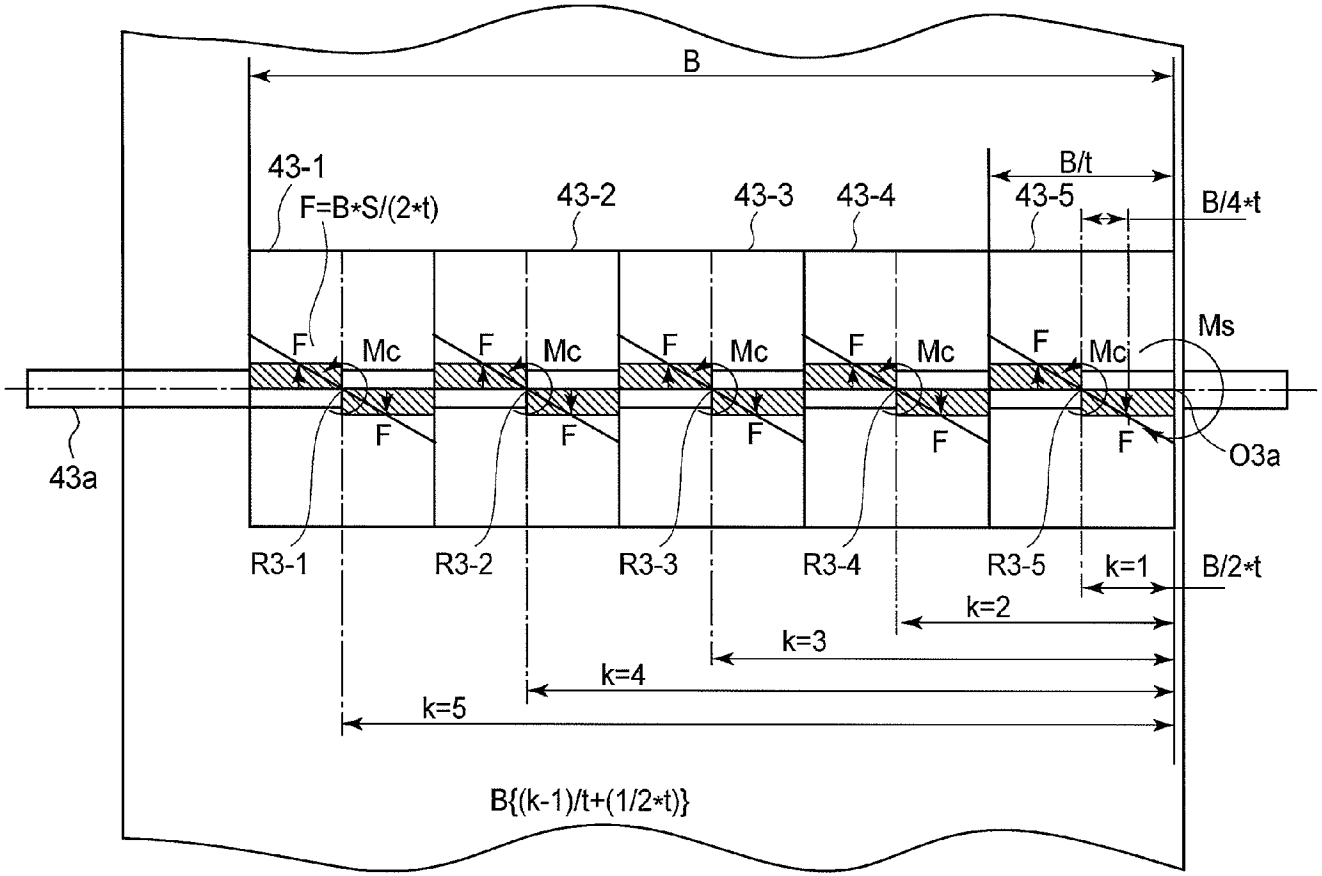
FIG. 14 is a schematic view showing the inclination operation of the tension roller according to the first embodiment.

FIG. 14 is a schematic view showing a state where friction forces are generated at widthwise centers R3-1, R3-2, R3-3, R3-4 and R3-5 of the respective roller parts 43-1, 43-2, 43-3, 43-4 and 43-5 in such a manner that the outer surfaces of the roller parts 43-1 through 43-5 rotate relative to the inner circumferential surface of the intermediate transfer belt 41.

The tension roller 43 divided into the roller parts 43-1 through 43-5 is inclined about the right end center O3*a* as was described with reference to FIGS. 12 and 13. Here, it is assumed that the outer surfaces of the roller parts 43-1 through 43-5 rotate without slippage on the inner circumferential surface of the intermediate transfer belt 41 at the widthwise centers of the roller parts 43-1 through 43-5. In this case, slippages occur between the outer surfaces of the respective roller parts 43-1 through 43-5 and the inner circumferential surface of the intermediate transfer belt 41 in such a manner that the outer surfaces of the roller parts 43-1 through 43-5 rotate about the widthwise centers R3-1 through R3-5.

In FIG. 14, a width of the roller body (i.e., the roller parts 43-1 through 43-5) of the tension roller 43 is expressed as B. A division number (i.e., the number of roller parts) is expressed as t. A friction force between the outer surface of the driving roller 43 and the inner circumferential surface of the intermediate transfer belt 41 per unit length is expressed as S. Here, it is assumed that a stretching force and a friction force applied to the tension roller 43 in the width direction due to the tension of the intermediate transfer belt 41 are both constant. Moments generated at the widthwise centers R3-1, R3-2, R3-3, R3-4 and R3-5 of the roller parts 43-1 through 43-5 are expressed as Mc. A moment generated by the moments Mc at the right end center O3*a* (assumed to the inclination center of the tension roller 43) is expressed as Ms. Friction forces between the outer surfaces of the roller parts 43-1 through 43-5 and the inner circumferential surface of the intermediate transfer belt 41 are expressed as F.

The friction force generated equally at both left and right portions of each of the roller parts 43-1 through 43-5 is expressed as follows:

$$F=B\times S/(2\times S) \tag{4}$$

This friction force F is generated at left and right portions each at a distance r from each of the widthwise centers R3-1 through R3-5, assuming that the friction force is evenly distributed in the widthwise direction. The distance r, and the moment Mc generated at the distance r are expressed as follows:

$$r=B/4\times t$$

$$Mc=2\times F\times r$$

$$Mc=B^2\times S/(4\times t^2) \tag{5}$$

The moment Ms about the right end center O3*a* of the tension roller 43 will be determined as follows. Here, N represents the division number (i.e., the number of roller parts of the tension roller 43).

A distance $r_n$ from the right end center O3*a* (i.e., a center of the moment Ms) to each of the widthwise centers R3-1 through R3-5 (i.e., centers of the moments Mc) is expressed as follows:

$$r_n=B\{(k-1)/t+(1/(2\times t))\}$$

Then, the following equations are obtained:

$$r_n = \frac{B}{t}\times\left\{(k-1)+\frac{1}{2}\right\} \tag{a}$$

$$Ms = \sum_{n=1}^{N}\frac{Mc}{r_n} \tag{b}$$

$$Ms = Mc\times\sum_{n=1}^{N}\frac{1}{r_n} \tag{c}$$

-continued $$Ms = Mc\times\sum_{k=1}^{N}\frac{t}{B\times\left\{(k-1)+\frac{1}{2}\right\}} \tag{d}$$

$$Ms = Mc\times\frac{t}{B}\times\sum_{k=1}^{N}\frac{1}{(k-1)+\frac{1}{2}} \tag{e}$$

$$Ms = Mc\times\frac{2\times t}{B}\times\sum_{k=1}^{N}\frac{1}{2k-1} \tag{f}$$

Here, the above described equation (5) is substituted into the equation (f), and the following equation is obtained:

$$Ms = \frac{1}{4\times t^2}\times B^2\times S\times\frac{2\times t}{B}\times\sum_{k=1}^{N}\frac{1}{2k-1} \tag{g}$$

Therefore, the following equations are obtained:

$$Ms = \frac{1}{2\times t}\times B\times S\times\sum_{k=1}^{N}\frac{1}{2k-1} \tag{6}$$

$$Ms = \frac{1}{2}\times B\times S\times\frac{1}{t}\times\sum_{k=1}^{N}\frac{1}{2k-1} \tag{7}$$

When the division number t=1 is substituted into the equation (7), the following equation is obtained:

$$Ms=(1/2)\times B\times S$$

This is the same equation as the above described equation (3).

When the division number t=5 is substituted into the equation (7), the following equation is obtained:

$$Ms=1/2\times B\times S\times 1/5\times(1+1/3+1/5+1/7+1/9)$$

$$Ms=1/2\times B\times S\times 563/1575$$

Therefore, when the division number t is 5, the moment Ms can be reduced by approximately 36% as compared with when the division number t is 1.

Table 1 shows the moments Ms for the division numbers 1 to 10 determined based on the equation (7), as compared to 100% for the moment Ms when the division number t is 1.

TABLE 1

| DIVISION NUMBER t | MOMENT Ms (%) |
|---|---|
| 1 | 100 |
| 2 | 67 |
| 3 | 51 |
| 4 | 42 |
| 5 | 36 |
| 6 | 31 |
| 7 | 28 |
| 8 | 25 |
| 9 | 23 |
| 10 | 21 |

Figure 15:
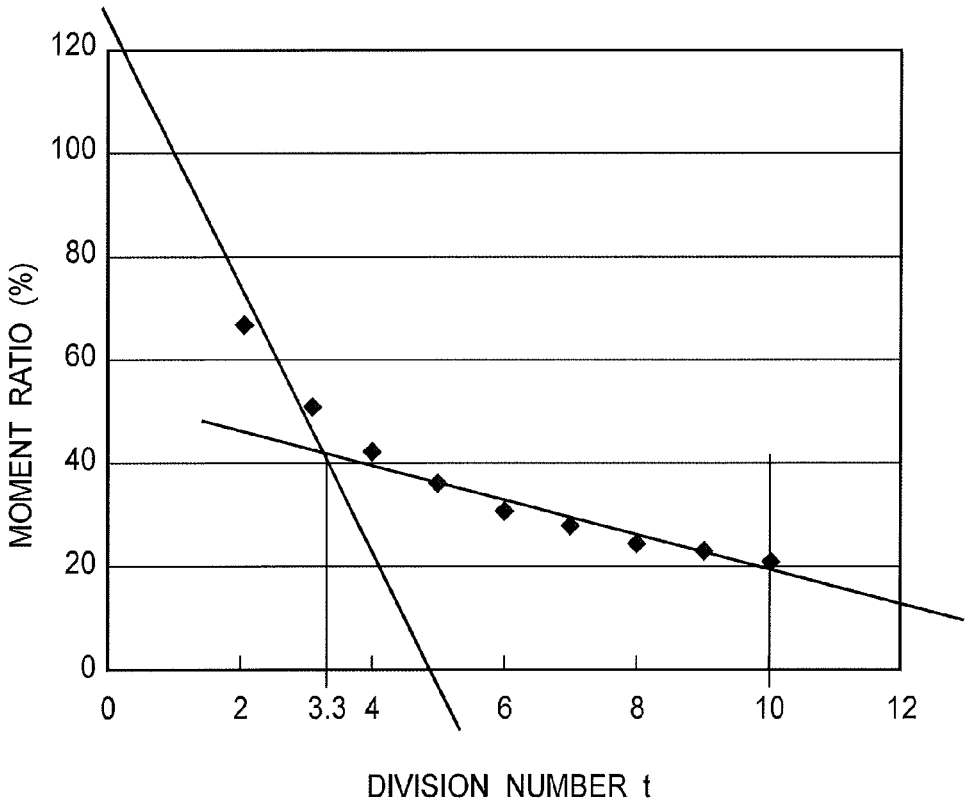
FIG. 15 is a graph showing a relationship between a division number of the tension roller and a moment ratio.

FIG. 15 is a graph showing a relationship between the division number t of the tension roller 43 and the ratio of the moment Ms caused by the friction.

In FIG. 15, a horizontal axis indicates the division number t. A vertical axis indicates a ratio of the moment Ms (for the division numbers 1 to 10) with respect to the moment Ms (100%) for the division number 1.

According to FIG. 15, a point of inflection of a curve of the ratio of the moment Ms is located in the vicinity of a point where the division number t is 3.3. This means that the effect of the first embodiment is more effectively achieved when the division number t is greater than or equal to 4.

Theoretically, the effect of the first embodiment is achieved more effectively as the division number (t) increases. However, in practice, it is preferable that the width of the each of the roller parts 43-1 through 43-5 of the tension roller 43 is greater than or equal to 30 mm. This is because, if the width of the roller part is less than 30 mm, there is a possibility that a backlash may occur between the tension roller 43 and the tension roller shaft 43*a* and may increase a load on the tension roller 43.

The upper limit of the division number t is determined by a maximum sheet size of the recording medium P used in the image forming apparatus 10. For example, if the maximum sheet size of the recording medium P used in the image forming apparatus 10 is A3 size, the width L of the tension roller 43 is determined to be approximately equal to the sheet width of 297 mm plus 40 mm. If the maximum sheet size of the recording medium P used in the image forming apparatus 10 is A4 size, the width L of the tension roller 43 is determined to be approximately equal to the sheet width of 210 mm plus 40 mm.

That is, when the image forming apparatus 10 is configured to use the recording medium P of up to A3 size, the division number t of the tension roller 43 is preferably less than or equal to 10. When the image forming apparatus 10 is configured to use the recording medium P of up to A4 size, the division number t of the tension roller 43 is preferably less than or equal to 8.

As a result, when the image forming apparatus 10 is configured to use the recording medium P of up to A3 size, the division number t of the tension roller 43 is preferably in a range from 4 to 10. When the image forming apparatus 10 is configured to use the recording medium P of up to A4 size, the division number t of the tension roller 43 is preferably in a range from 4 to 8.

As described above, as the tension roller 43 is divided in the axial direction into a plurality of roller parts 43-1 through 43-5, it becomes possible to reduce the load on the tension roller 43 due to the friction between the outer surface of the tension roller 43 and the inner circumferential surface of the intermediate transfer belt 41 during the inclination operation.

To be more specific, since the friction force between the tension roller 43 and the intermediate transfer belt 41 is dispersed, the contact force between the flange portion 56*b* and the intermediate transfer belt becomes constant. Therefore, when the intermediate transfer belt 41 is guided to a stable position by the flange portion 56*b* of the pulley 56 (in the case where the intermediate transfer belt 41 skews), it becomes possible to prevent the intermediate transfer belt 41 from being deformed by excessive load to pass over the flange 56*b*.

The above description has been made on the assumption that the slippage between the tension roller 43 and the intermediate transfer belt 41 does not occur at the widthwise center R2C of the tension roller 43. However, a portion where the slippage does not occur can be located on any other position on the rotation axis O2 of the tension roller 43.

<Advantages>

According to the transfer belt unit 40, the tension roller 43 is divided in the axial direction into a plurality of the roller parts 43-1 through 43-5, and the roller parts 43-1 through 43-5 are independently rotatable. Therefore, it becomes possible to reduce the friction between the outer surface of the tension roller 43 and the inner circumferential surface of the intermediate transfer belt 41 during the inclination operation. Accordingly, the tension roller 43 can smoothly perform the inclination operation with small load. Thus, the contact force (stress) between the lateral end of the intermediate transfer belt 41 and the pulley 56 can be reduced. As a result, a lifetime of the transfer belt unit 40 can be lengthened.

Second Embodiment

<Configuration>

Figure 16A:
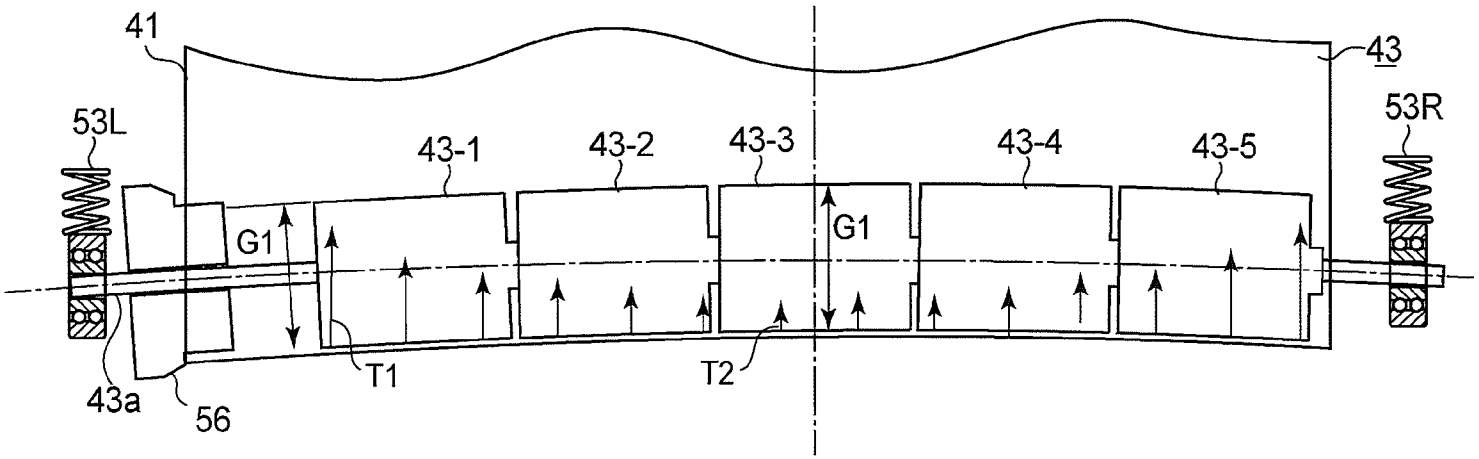
FIGS. 16A and 16B are plan views showing a tension roller according to the second embodiment of the present invention.
Figure 16B:
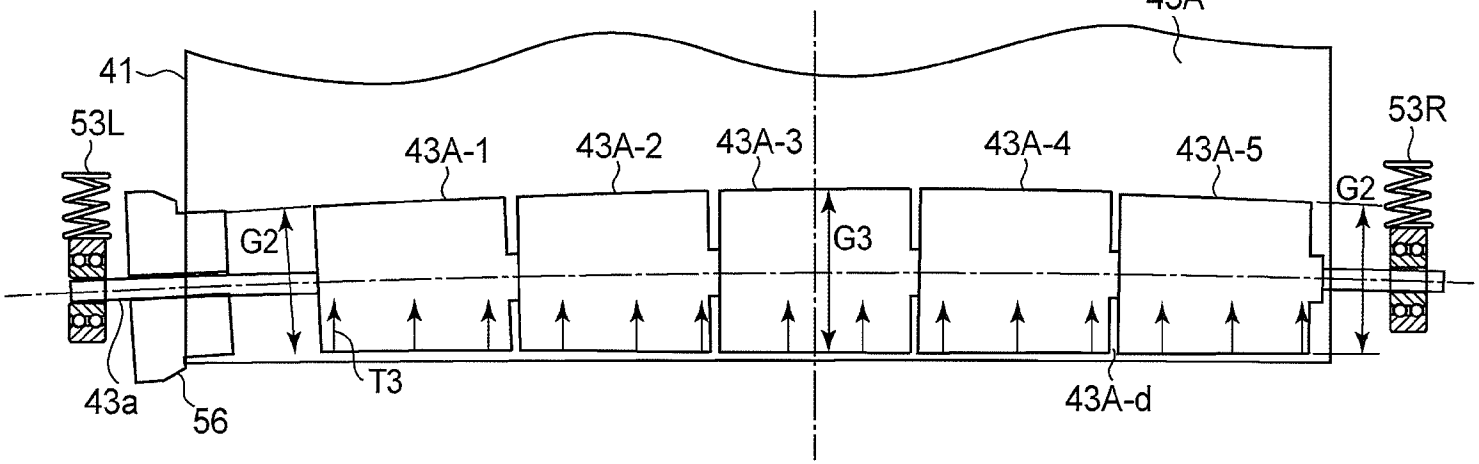
Figure 17:
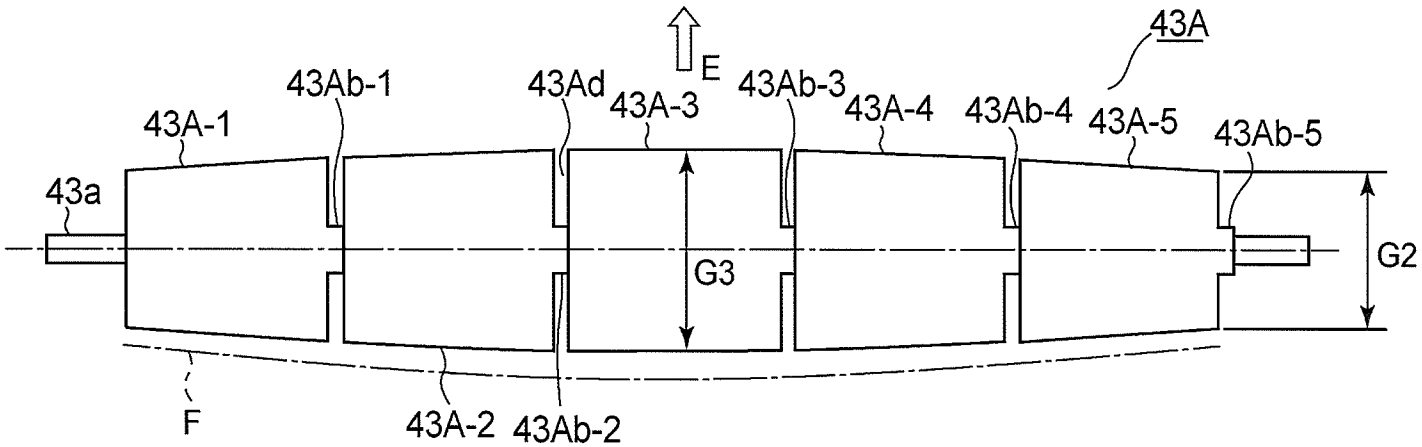
FIG. 17 is a plan view showing the tension roller according to the second embodiment.

FIGS. 16A and 16B are schematic views showing the tension roller 43 according to the first embodiment and a tension roller 43A (as a first rotation member) according to the second embodiment of the present invention both in assembled state. FIG. 17 shows the tension roller 43A of the second embodiment shown in FIG. 16B.

The transfer belt unit of the second embodiment is the same as the transfer belt unit 40 of the first embodiment except the tension roller 43 (43A).

As shown in FIG. 16A, the tension roller 43 (the roller parts 43-1 through 43-5) of the first embodiment has a straight shape. That is, the outer diameter G1 at the center of the tension roller 43 is the same as the outer diameter G1 at the end of the tension roller 43. In contrast, in the second embodiment, as shown in FIG. 16B, the outer diameter G3 at the center of the tension roller 43A (the roller parts 43A-1 through 43A-5) is larger than the outer diameter G2 at both ends of the tension roller 43A.

More specifically, the tension roller 43A of the second embodiment has a crown shape such that the outer diameter G3 at the center of the tension roller 43A is slightly larger than the outer diameter G2 at both end of the tension roller 43A.

A difference between the outer diameters G2 and G3 at both ends of the tension roller 43 is determined taking into consideration a deflection of the tension roller shaft 43*a* caused when the tension is applied to the intermediate transfer belt 41 by the springs 53L and 53R.

As shown in FIG. 17, the tension roller shaft 43*a* penetrates through the roller parts 43A-1 through 43A-5 of the tension roller 43A to rotatably support the roller parts 43A-1 through 43A-5. The roller parts 43A-1 through 43A-5 have ring-shaped boss portions 43A*b*-1, 43A*b*-2, 43A*b*-3, 43A*b*-4 and 43A*b*-5, and form gaps 43Ad between adjacent roller parts 43A-1 through 43A-5. The outer diameter G2 at both ends of the tension roller 43A is smaller than the outer diameter G3 at the center of the tension roller 43A as described above. With the provision of the gaps 43Ad, the roller parts 43A*b*-1 through 43A*b*-5 do not interfere with each other, even when the tension roller shaft 43*a* is deflected by a force as shown by an arrow E. Further, when the deflection of the tension roller shaft 43*a* occurs, outer surfaces of the roller parts 43A*b*-1 through 43A*b*-5 on a side opposite to the driving roller 42 (shown by a line F in FIG. 17) are aligned substantially straightly as shown in FIG. 16B.

<Operation>

Operations of the image forming apparatus 10 and the transfer belt unit 40 of the second embodiment are the same as those of the first embodiment.

An operation of the tension roller 43A of the second embodiment will be described. The tension roller 43 of FIG. 16 has a straight shape and is divided into a plurality of roller parts, as was described in the first embodiment. In this case, when tension roller shaft 43*a* is deflected due to the tension of the intermediate transfer belt 41 applied by the springs 53L and 53R, there arises a difference between a stretching force T1 (per unit width) at the end of the tension roller 43 and a stretching force T2 (per unit width) at the center of the tension roller 43.

Since the tension roller 43 (FIG. 16A) is divided into a plurality of roller parts, a bending strength of the tension roller 43 as a whole is relatively low. Therefore, the difference between the stretching forces T1 and T2 becomes relatively large. Depending on the strength of the tension roller shaft 43*a* and the spring forces of the springs 53L and 53R, large stretching forces may be intensively generated at the ends of the tension roller 43. In such a case, a tensile stress at the lateral end of the intermediate transfer belt 41 in the circumferential direction may increase, and the lifetime of the intermediate transfer belt 41 may be reduced.

As a countermeasure, it is possible to enhance a rigidity of the tension roller shaft 43*a* by, for example, increasing the outer diameter of the tension roller shaft 43*a* or using a hollow shaft. However, in such a case, a weight of the tension roller shaft 43*a* may increase, or a manufacturing cost may increase.

In contrast, according to the second embodiment, the outer diameter G2 at both ends of the tension roller 43A (the roller parts 43A-1 through 43A-5) is smaller than the outer diameter G3 at the center of the tension roller 43A as described above. Therefore, as shown in FIG. 16B, it becomes possible to reduce a difference between a stretching force T3 (per unit width) at the end of the tension roller 43A and a stretching force T4 (per unit width) at the center of the tension roller 43A.

<Advantages>

According to the second embodiment, the tension roller 43A is divided into a plurality of roller parts, and has a shape such that the outer diameter G3 at the center is larger than the outer diameter G2 at the end. Therefore, the stretching force T3 (per unit width) at the end of the tension roller 43A can be reduced, and a difference between the stretching force T3 at the end of the tension roller 43A and the stretching force T4 at the center of the tension roller 43A can be reduced. Accordingly, the intermediate transfer belt 41 becomes able to smoothly move. Further, since the tensile stress at the lateral ends of the intermediate transfer belt 41 can be reduced, the lifetime of the transfer belt unit 40 can be lengthened.

Modifications.

Following modifications can be made to the above described embodiments.

In the first and second embodiments, it is described that the belt driving device is used as the transfer belt unit 40 employed in the electrophotographic printer. However, the belt driving device of the present invention can be employed in other image forming apparatuses such as a copier, a facsimile machine or the like that form an image on the recording medium using electrophotography.

In the first and second embodiments, it is described that the belt driving device is employed in the image forming apparatus 10 of the intermediate transfer type that forms a developer image on the intermediate transfer belt 41 and transfers the developer image to the recording medium P. However, the belt driving device of the present invention can be applicable to a direct transfer type image forming apparatus that forms a developer image on the OPC drum 31, and directly transfer the developer image from the OPC drum to the recording medium P.

In the first and second embodiments, it is described that the belt driving device is used as the transfer belt unit 40 employed in the electrophotographic image forming apparatus. However, the belt driving device of the present invention can also be employed in a fixing unit and a medium conveying device using an endless belt. Further, the belt driving device of the present invention can be used for other purposes than the electrophotographic image forming apparatus as long as an endless belt (i.e., a stretched member) is used.

In the first and second embodiment, the endless belt (more specifically, the intermediate transfer belt) has been described as an example of a stretched member. However, it is also possible to use other stretched members such as an ended (i.e., non-endless) belt, an endless sheet, an ended sheet or the like.

Figures 18A, 18B, 18C:
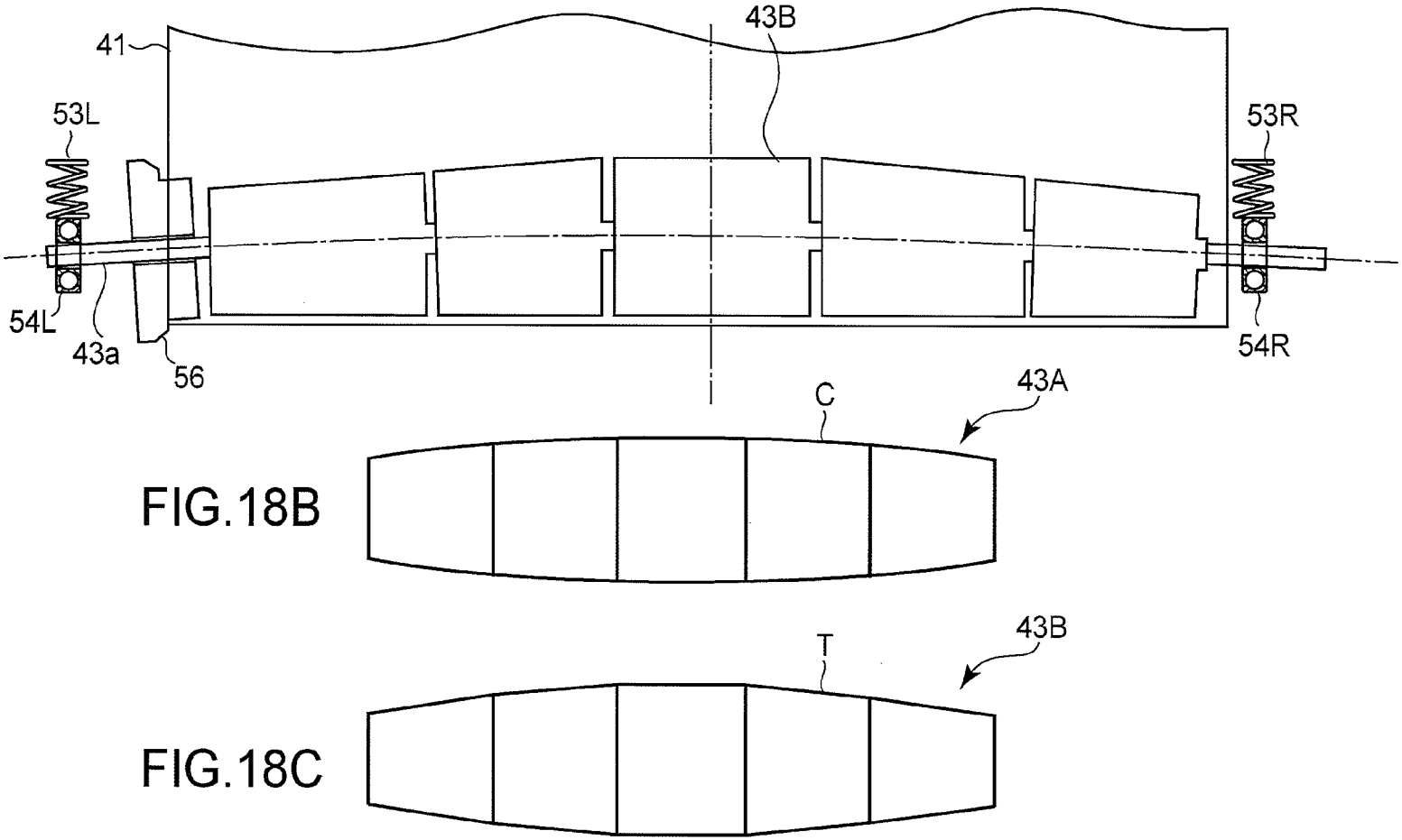
FIG. 18A is a plan view showing a modification of the tension roller of the second embodiment.
FIG. 18B is a schematic view showing a shape of the tension roller of FIG. 17.
FIG. 18C is a schematic view showing a shape of the tension roller of FIG. 18A.

FIG. 18A shows a tension roller 43B according to a modification of the second embodiment. Although the tension roller 43A of the second embodiment (see FIGS. 16B and 17) has the crown shape, the tension roller 43B of this modification (FIG. 18) has a tapered shape, and the outer diameter gradually increases from each end toward the center of the tension roller 43B in such a manner that a difference between diameters at opposing ends of adjacent roller parts is minimized.

For comparison, FIG. 18B schematically shows the crown shape of the tension roller 43A of the second embodiment (FIGS. 16B and 17), and FIG. 18C schematically shows the tapered shape of the tension roller 43B of the modification (FIG. 18A). As shown in FIG. 18B, the tension roller 43A of the second embodiment has the crown shape whose outer periphery has a continuous smooth curve C along the axial direction. As shown in FIG. 18C, the tension roller 43B of the modification has a tapered shape whose outer periphery includes a plurality of straight tapers T. If the tension roller 43B includes odd number of roller parts, the center roller part has a cylindrical shape. Using the tension roller 43B having the tapered shape as shown in FIGS. 18A and 18C, the same advantages as in the second embodiment can be achieved.

Moreover, the features of the tension roller 43 in the first and second embodiments can also be applied to the backup roller 44 and/or the driving roller 42.

Figure 19:
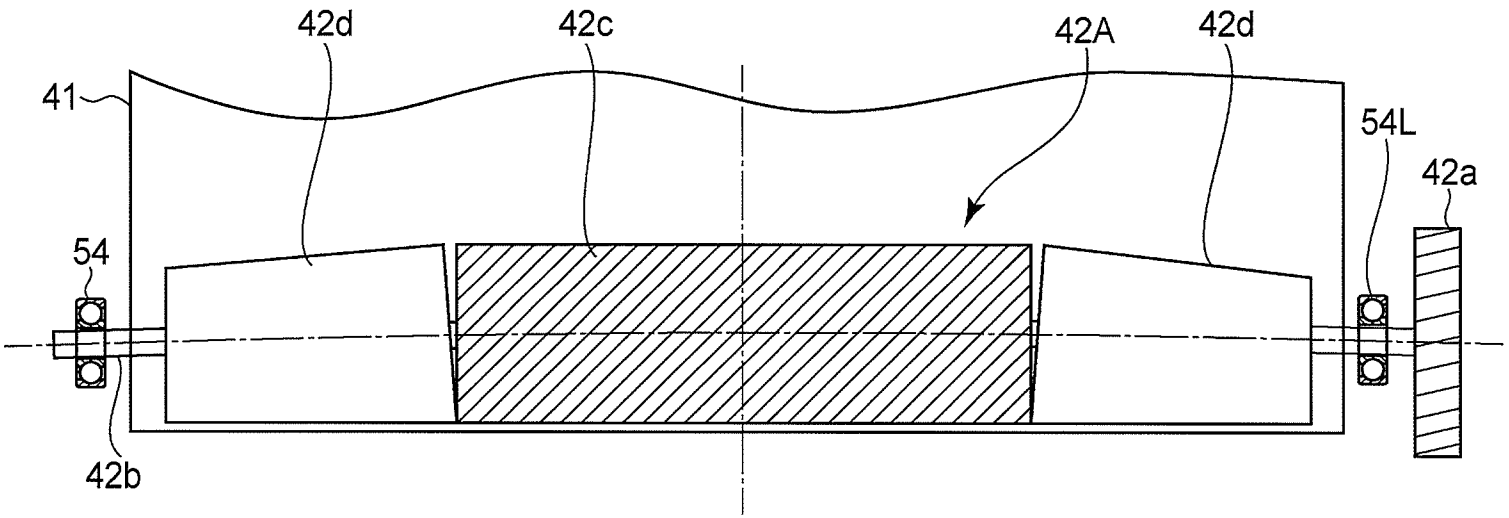
FIG. 19 is a plan view showing a modification of the driving roller to the second embodiment.

For example, FIG. 19 shows a modification in which the feature (FIGS. 16B and 17) of the second embodiment is applied to the driving roller 42.

The driving roller 42A shown in FIG. 19 is divided into a plurality of roller parts. More specifically, the driving roller 42A is divided into a roller part 40*c* at the center of the driving roller 42, and roller parts 40*d* on both sides of the roller part 40*c*. The roller part 40*c* is fixed to a driving roller shaft 42*b*, and has a circumferential surface of high friction. The roller parts 40*d* are rotatably supported by the driving roller shaft 42*b*, and each roller part 40*d* has a tapered shape such that the outer diameter increases toward the roller part 40*c*. With such a modification, the advantages described in the second embodiment can be achieved.

Figure 20A:
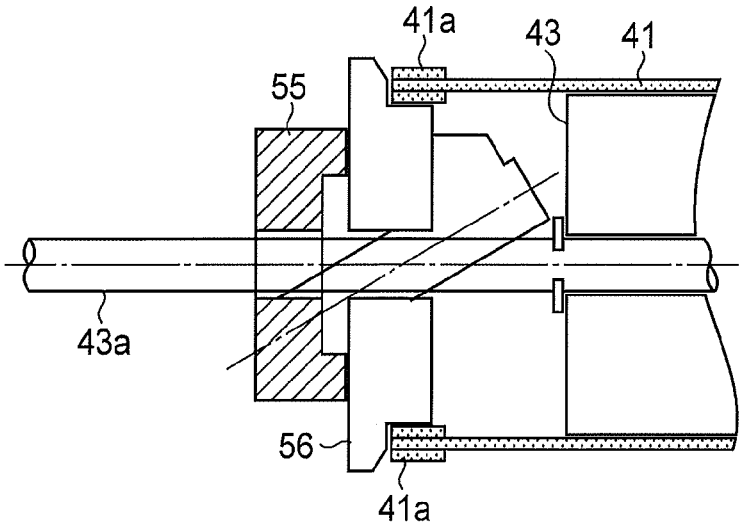
FIGS. 20A and 20B are enlarged views showing a modification of a configuration at the end of the tension roller of the second embodiment.
Figure 20B:
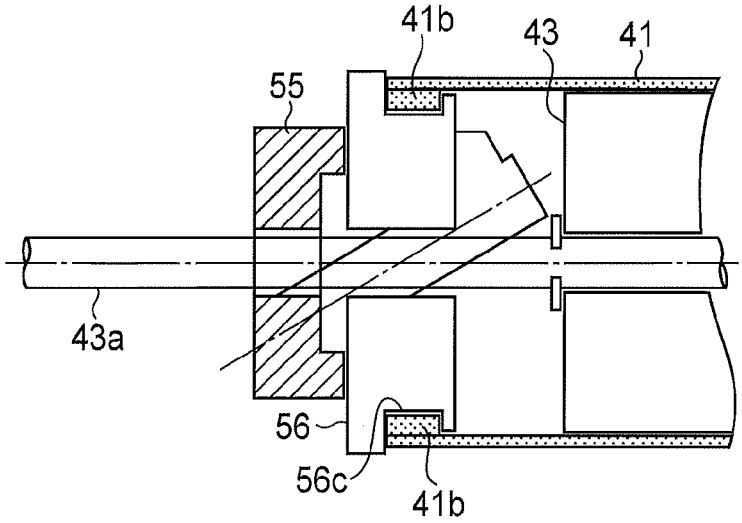

FIGS. 20A and 20B are enlarged views showing modifications of configurations at the end portion of the tension roller 43. As shown in FIG. 20A, a reinforcing member 41*a* can be provided at the lateral end of the intermediate transfer belt 41. Further, as shown in FIG. 20B, a guide member 41*b* can be provided on the inner circumferential surface at the lateral end of the intermediate transfer belt 41. In this case, the pulley 56 is provided with a groove 56*c* engaging the guide member 41*b*. With such modifications, the advantages described in the first and second embodiments can be achieved.

While the preferred embodiments of the present invention have been illustrated in detail, it should be apparent that modifications and improvements may be made to the invention without departing from the spirit and scope of the invention as described in the following claims.

What is claimed is:

1. A driving device comprising:

a first rotation member having a first rotation axis, said first rotation member including a plurality of roller parts arranged coaxially with each other and in an axial direction of said first rotation axis, a total number of said roller parts being in a range from 4 to 10;

a second rotation member having a second rotation axis;

a stretched member stretched around the first rotation member and the second rotation member, outer surfaces of the roller parts contacting an inner surface of the stretched member;

a shaft shifting member provided on at least one end of said first rotation member, said shaft shifting member being configured to shift at least one end of said first rotation axis in accordance with a movement of said stretched member in said axial direction of said first rotation axis, said shaft shifting member being provided on a first end of said first rotation member;

a pulley provided between said shaft shifting member and said first rotation member;

a first regulating member provided between said pulley and said first rotation member, said first regulating member regulating a movement of said first rotation member in said axial direction;

a second regulating member provided on a second end of said first rotation member, said second regulating member regulating the movement of said first rotation member in said axial direction; and a spacer provided on an outer side of said second regulating member, said spacer regulating the movement of said first rotation member in said axial direction.

2. The driving device according to claim 1, wherein a gap is formed between adjacent roller parts of said plurality of roller parts.

3. The driving device according to claim 1, wherein at least one of said plurality of roller parts includes:

a stretching portion around which said stretched member is stretched, and at least one abutting portion protruding from said stretching portion in said axial direction of said first rotation axis.

4. The driving device according to claim 3, wherein said abutting portion has an outer diameter smaller than an outer diameter of said stretching portion.

5. The driving device according to claim 1, wherein said first rotation member has a shape such that an outer diameter at a center of said first rotation member is larger than an outer diameter of each end of said first rotation member.

6. The driving device according to claim 1, wherein said first rotation member has a tapered shape such that an outer diameter of said first rotation member decreases from a center to both ends.

7. The driving device according to claim 1, wherein said shaft shifting member has a third rotation axis inclined with respect to said first rotation axis of said first rotation member, and rotates about said third rotation axis so as to shift said first rotation axis of said first rotation member.

8. The driving device according to claim 1, wherein said pulley has a contact portion contacting said stretched member, wherein said pulley moves in said axial direction of said first rotation axis to cause said contact portion to contact said stretched member in accordance with a rotation of said shaft shifting member.

9. The driving device according to claim 8, wherein said pulley includes a flange, and said flange has a tapered portion.

10. The driving device according to claim 1, wherein said second rotation member includes a driving roller for driving said stretched member.

11. The driving device according to claim 1, wherein said stretched member includes an endless belt.

12. An image forming apparatus comprising:

said driving device according to claim 1;

an image forming portion that forms a developer image; and a fixing portion that fixes said developer image to a medium.

13. The driving device according to claim 1, wherein each of the roller parts has an outermost surface touching the stretched member.

14. The driving device according to claim 13, wherein the roller parts include all rollers covered by the stretched member.

15. The driving device according to claim 1, wherein the roller parts constitute a divided roller.

16. The driving device according to claim 1, wherein said first regulating member is provided at a distance from said pulley.

17. The driving device according to claim 16, wherein when said stretched member moves in said axial direction of said first rotation axis, said pulley moves together with said stretched member, and said distance between said pulley and said first regulating member changes.

18. The driving device according to claim 1, wherein said first rotation member includes a larger-diameter part and a smaller-diameter part that has a smaller diameter than that of the larger-diameter part, wherein said first regulating member regulates the movement of said first rotation member in said axial direction at said larger-diameter part, wherein said second regulating member regulates the movement of said first rotation member in said axial direction at said smaller-diameter part.

19. The driving device according to claim 1, wherein said first regulating member is provided only on said first end of said first rotation member, wherein said second regulating member and said spacer are provided only on said second end of said first rotation member.

20. The driving device according to claim 19, wherein said first regulating member and said second regulating member have identical shapes, and wherein said spacer has a different shape from the shapes of said first regulating member and said second regulating member.

21. The driving device according to claim 1, wherein a distance from one end of said plurality of roller parts to another end of said plurality of roller parts is shorter than a width of said stretched member.

* * * * *